US010826183B2

(12) United States Patent
Celik

(10) Patent No.: US 10,826,183 B2
(45) Date of Patent: Nov. 3, 2020

(54) CIRCULARLY POLARIZED ANTENNAS

(71) Applicant: Trimble Inc., Sunnyvale, CA (US)

(72) Inventor: Nuri Celik, Milpitas, CA (US)

(73) Assignee: Trimble Inc., Sunnyvale, CA (US)

( * ) Notice: Subject to any disclaimer, the term of this patent is extended or adjusted under 35 U.S.C. 154(b) by 0 days.

(21) Appl. No.: 16/681,618

(22) Filed: Nov. 12, 2019

(65) Prior Publication Data

US 2020/0083608 A1 Mar. 12, 2020

Related U.S. Application Data

(62) Division of application No. 15/394,309, filed on Dec. 29, 2016, now Pat. No. 10,505,279.

(51) Int. Cl.
*H01Q 9/04* (2006.01)
*H01Q 1/48* (2006.01)
(Continued)

(52) U.S. Cl.
CPC ..... *H01Q 9/0428* (2013.01); *H01Q 1/38* (2013.01); *H01Q 1/48* (2013.01); *H01Q 5/40* (2015.01);
(Continued)

(58) Field of Classification Search
CPC ..... H01Q 5/40; H01Q 13/10; H01Q 13/08; H01Q 9/0435; H01Q 9/0478;
(Continued)

(56) References Cited

U.S. PATENT DOCUMENTS 4,208,660 A 6/1980 McOwen, Jr.
5,714,961 A * 2/1998 Kot ..... H01Q 13/106 343/700 MS
(Continued)

FOREIGN PATENT DOCUMENTS

JP WO2014108977 * 7/2014
WO 2016/109403 A1 7/2016
(Continued)

OTHER PUBLICATIONS

Ruvio et al. (Radial EBG cell layout for GPS patch antennas. (Year: 2009).*
(Continued)

*Primary Examiner* — Awat M Salih
(74) *Attorney, Agent, or Firm* — Kilpatrick Townsend & Stockton LLP

(57) ABSTRACT

An antenna includes a dielectric substrate, a circular patch overlying the dielectric substrate, and a metamaterial ground plane. One or more antenna feeds are coupled to the circular patch. The antenna feeds may include impedance transformers. The metamaterial ground plane includes a plurality of conductive patches and a ground plane. The conductive patches are arranged along a first plane below the circular patch and are separated from the circular patch by at least the dielectric substrate. The conductive patches are arranged in a pattern that provides circular symmetry with respect to a center of the circularly polarized antenna. The ground plane is arranged along a second plane and is electrically coupled to at least a first portion of the conductive patches. One or more of the conductive patches and the ground plane are coupled to ground.

20 Claims, 18 Drawing Sheets

(51) Int. Cl.

| | |
|---|---|
| ***H01Q 1/38*** | (2006.01) |
| ***H01Q 5/40*** | (2015.01) |
| ***H01Q 13/10*** | (2006.01) |
| ***H01Q 13/08*** | (2006.01) |
| ***H01Q 15/00*** | (2006.01) |

(52) U.S. Cl.
CPC ..... *H01Q 9/0435* (2013.01); *H01Q 9/0464* (2013.01); *H01Q 9/0478* (2013.01); *H01Q 13/08* (2013.01); *H01Q 13/10* (2013.01); *H01Q 15/006* (2013.01); *H01Q 15/0086* (2013.01)

(58) Field of Classification Search
CPC .. H01Q 9/0464; H01Q 9/0428; H01Q 9/0407; H01Q 15/0086; H01Q 15/006; H01Q 1/48; H01Q 1/38
See application file for complete search history.

(56) References Cited

U.S. PATENT DOCUMENTS

| | | | | |
|---|---|---|---|---|
| 6,262,495 | B1 | 7/2001 | Yablonovitch et al. | |
| 6,597,316 | B2 * | 7/2003 | Rao | H01Q 9/0407 343/700 MS |
| 6,847,328 | B1 | 1/2005 | Libonati et al. | |
| 7,436,363 | B1 | 10/2008 | Klein et al. | |
| 7,446,712 | B2 | 11/2008 | Itoh et al. | |
| 7,994,997 | B2 | 8/2011 | Livingston et al. | |
| 8,610,635 | B2 | 12/2013 | Huang et al. | |
| 9,184,504 | B2 * | 11/2015 | Tatarnikov | H01Q 9/0464 |
| 9,590,314 | B2 | 3/2017 | Celik | |
| 10,181,646 | B2 | 1/2019 | Celik | |
| 10,381,732 | B2 | 8/2019 | Celik | |
| 10,505,279 | B2 | 12/2019 | Celik | |
| 2004/0080455 | A1 | 4/2004 | Lee | |
| 2007/0052587 | A1 * | 3/2007 | Cheng | H01Q 9/0407 343/700 MS |
| 2007/0285324 | A1 | 12/2007 | Waterhouse et al. | |
| 2008/0042903 | A1 * | 2/2008 | Cheng | H01Q 9/0485 343/700 MS |
| 2008/0204326 | A1 * | 8/2008 | Zeinolabedin Rafi | H01Q 9/0414 343/700 MS |
| 2010/0060535 | A1 * | 3/2010 | Tiezzi | H01Q 5/40 343/770 |
| 2010/0090903 | A1 * | 4/2010 | Byun | H01Q 13/18 343/700 MS |
| 2014/0028524 | A1 | 1/2014 | Jerauld et al. | |
| 2015/0123869 | A1 * | 5/2015 | Bit-Babik | H01Q 3/247 343/857 |
| 2016/0164182 | A1 | 6/2016 | Lai et al. | |
| 2016/0190704 | A1 | 6/2016 | Celik | |
| 2016/0191073 | A1 | 6/2016 | Zhu | |
| 2017/0033468 | A1 | 2/2017 | Wong | |
| 2018/0191073 | A1 | 7/2018 | Celik | |
| 2018/0205151 | A1 | 7/2018 | Celik | |
| 2019/0074592 | A1 | 3/2019 | Celik | |

FOREIGN PATENT DOCUMENTS

| | | | |
|---|---|---|---|
| WO | 2018/125670 | A1 | 7/2018 |
| WO | 2018/136421 | A1 | 7/2018 |

OTHER PUBLICATIONS

Tanabe, M. et al., "A Bent-Ends Spiral Antenna above a Fan-Shaped Electromagnetic Band-Gap Structure," 9th European Conference on Antennas and Propagation, EURAAP, Apr. 13, 2015, pp. 1-4 page.
Ruvio, G. et al., "Radial EBG cell layout for GPS patch antennas," Electronic Letters, the Institution of Engineering and Technology, Jun. 18, 2009, vol. 45, No. 13, pp. 663-664.
Boyko, S. N. et al., "EBG Metamaterial Ground Plane Application for GNSS Antenna Multipath Mitigating," 2015 International Workshop on Antenna Technology (IWAT), IEEE, Mar. 4, 2015, pp. 178-181.
International Search Report and Written Opinion for Application No. PCT/US2017/067276, dated Mar. 19, 2018, 20 pages.
International Search Report and Written Opinion for Application No. PCT/US2018/013876, dated Jun. 13, 2018, 15 pages.
Amiri, M. et al., "Gain and Bandwidth Enhancement of a Spiral Antenna Using a Circularly Symmetric HIS," IEEE Antennas and Wireless Propagation Letters, vol. 16, Oct. 27, 2016, pp. 1080-1083.
Amiri, M. et al., "Analysis, Design, and Measurements of Circularly Symmetric High-Impedance Surfaces for Loop Antenna Applications," IEEE Transactions on Antennas and Propagation, vol. 64, No. 2, Feb. 1, 2016, pp. 618-629.
Bian et al., "Wideband circularly polarised slot antenna," IET Microwaves, Antennas & Propagation, vol. 2, No. 5, Aug. 4, 2008, pp. 497-502, XP006031283; doi: 10.1049/iet-map:20070243.
Grelier, M. et al., "Axial ratio improvement of an Archimedean spiral antenna over a radial AMC reflector," Applied Physics A Materials Science & Processing, Nov. 10, 2012, vol. 109, No. 4, pp. 1081-1086.
Karmakar, N. C., "Investigations Into a Cavity-Backed Circular-Patch Antenna," IEEE Transactions on Antennas and Propagation, vol. 50, Dec. 1, 2002, pp. 1706-1715.
Payandehjoo et al., "Suppression of Substrate Coupling Between Slot Antennas Using Electromagnetic Bandgap Structures," Antennas and Propagation Society International Symposium, 2008, AP-S, 2008. IEEE, IEEE, Piscataway, NJ, USA, Jul. 5, 2008; pp. 1-4, XP31824233.
Ramirez et al., "Concentric Annular Ring Slot Antenna for Global Navigation Satellite Systems," IEEE Antennas and Wireless Propagation Letters, IEEE, Piscataway, NJ, US, vol. 11, Jan. 1, 2012, pp. 705-707, XP11489275.
Sun et al., "Design and Investigation of a Dual-Band Annular Ring Slot Antenna for Aircraft Applications," Progress in Electromagnetics Research C, vol. 38, Jan. 1, 2013, pp. 6778, XP055265587.
U.S. Appl. No. 15/410,086 First Action Interview Pilot Program Pre-Interview Communication dated May 29, 2018, 5 pages.
U.S. Appl. No. 15/410,086 Notice of Allowance dated Sep. 6, 2018, 14 pages.
U.S. Appl. No. 16/182,852 Preinterview First Office Action dated Jan. 3, 2019, 4 pages.
U.S. Appl. No. 16/182,852 Notice of Allowance dated Mar. 28, 2019, 9 pages.
U.S. Appl. No. 15/394,309 Restriction Requirement dated Nov. 5, 2018, 7 pages.
U.S. Appl. No. 15/394,309 Non-Final Office Action dated Mar. 18, 2019, 23 pages.
U.S. Appl. No. 15/394,309 Final Office Action dated May 29, 2019, 22 pages.
U.S. Appl. No. 15/394,309 Notice of Allowance dated Aug. 7, 2019, 8 pages.
U.S. Appl. No. 14/587,641 First Action Interview Pilot Program Pre-Interview Communication dated Aug. 12, 2016, 5 pages.
U.S. Appl. No. 14/587,641 First Action Interview Office Action Summary dated Oct. 3, 2016, 7 pages.
U.S. Appl. No. 14/587,641 Notice of Allowance dated Oct. 26, 2016, 9 pages.
International Application No. PCT/US2015/067621, International Search Report and Written Opinion dated Apr. 26, 2016, 14 pages.
Jensen et al., "Coupled Transmission Lines as Impedance Transformer" IEEE Transactions on Microwave Theory and Techniques, vol. 55, No. 12, Dec. 2007, 9 pages.
Rayno et al., "Dual-Polarization Cylindrical Long-Slot Array (CLSA) Antenna Integrated With Compact Broadband Baluns and Slot Impedance Transformers" IEEE Antennas and Wireless Propagation Letters, vol. 12, 2013, 4 pages.

* cited by examiner

CIRCULARLY POLARIZED ANTENNAS

CROSS-REFERENCE TO RELATED APPLICATION

This application is a divisional of U.S. patent application Ser. No. 15/394,309, filed Dec. 29, 2016, the entire contents of which are incorporated by reference herein for all purposes.

FIELD OF THE INVENTION

Embodiments described herein relate generally to slot antennas, and more particularly, to circularly polarized connected-slot antennas.

BACKGROUND

Conventional slot antennas include a slot or aperture formed in a conductive plate or surface. The slot forms an opening to a cavity, and the shape and size of the slot and cavity, as well as the driving frequency, contribute to a radiation pattern. The length of the slot depends on the operating frequency and is typically about $\lambda/2$ and inherently narrowband. Conventional slot antennas are linearly polarized and can have an almost omnidirectional radiation pattern. More complex slot antennas may include multiple slots, multiple elements per slot, and increased slot length and/or width.

Slot antennas are commonly used in applications such as navigational radar and cell phone base stations. They are popular because of their simple design, small size, and low cost. Improved designs are constantly sought to improve performance of slot antennas, increase their operational bandwidth, and extend their use into other applications.

SUMMARY

Embodiments described herein provide improved designs for slot antennas. In an embodiment, the slot is formed in a circular shape and includes one or more feed elements that can be phased to provide circular polarization. The slot is connected in the sense that it is formed by a dielectric extending between conductors. The connected-slot antennas described herein can be configured for specific frequencies, wider bandwidth, and different applications such as receiving satellite signals at global navigation satellite system (GNSS) frequencies (e.g., approximately 1.1-2.5 GHz).

In accordance with an embodiment, a circularly polarized connected-slot antenna configured to receive radiation at GNSS frequencies includes a dielectric substrate, a circular patch overlying the dielectric substrate, one or more impedance transformers, and a metamaterial ground plane. Each of the one or more impedance transformers include a microstrip overlying the dielectric substrate and a ground pad that is separated from the microstrip by a dielectric. Each microstrip is coupled to a first antenna feed at an input and coupled to the circular patch at an output. Each ground pad is coupled to ground. The metamaterial ground plane includes a plurality of conductive patches, a ground plane, and a conductive fence. The plurality of conductive patches are arranged along a first plane below the circular patch and are separated from the circular patch by at least the dielectric substrate. Each conductive patch is separated from others of the conductive patches. The plurality of conductive patches are arranged in a pattern that provides circular symmetry with respect to a center of the circularly polarized antenna.

The ground plane is arranged along a second plane and is electrically coupled to at least a first portion of the plurality of conductive patches. The conductive fence extends around a perimeter of the plurality of conductive patches and around a perimeter of the ground plane. The ground plane and the conductive fence are coupled to ground.

In embodiments that include more than one impedance transformer, the output associated with each microstrip is spaced from adjacent outputs associated with other microstrips by approximately equal angular intervals.

In an embodiment, the plurality of conductive patches are arranged in a pattern that provides circular symmetry with respect to a phase center of the circularly polarized antenna.

In another embodiment, the plurality of conductive patches include a center conductive patch surrounded in a radial direction by a plurality of intermediate conductive patches. In some embodiments, the plurality of intermediate conductive patches may extend radially to an outer edge of the dielectric substrate. In other embodiments, the plurality of intermediate conductive patches may be surrounded in a radial direction by a plurality of outer conductive patches. The plurality of outer conductive patches may extend radially to an outer edge of the dielectric substrate.

In another embodiment, the circularly polarized antenna includes a conductive ring surrounding the circular patch and overlying the dielectric substrate. The conductive ring may be coupled to ground and isolated from the circular patch.

In another embodiment, the circularly polarized antenna includes a discontinuous ring comprising discrete conductive elements surrounding the circular patch.

In some embodiments, the dielectric separating each microstrip and ground pad is the dielectric substrate. In other embodiments, the dielectric separating each microstrip and ground pad is separate from the dielectric substrate.

In another embodiment, each microstrip includes at least two conductive traces. A first one of the at least two conductive traces has one end connected to the first antenna feed and another end connected to the output. A second one of the at least two conductive traces has one end connected to the first antenna feed and another end free from connection with a conductor. The first conductive trace and the second conductive trace extend substantially parallel to but separate from each other along multiple sections of the microstrip. Each section of the microstrip extends substantially perpendicular to an adjacent section of the microstrip. In some embodiments, a width of the first one of the at least two conductive traces decreases between the first antenna feed and the output.

In another embodiment, the circular patch comprises an inner conductive ring.

In another embodiment, the circular patch is disposed on a top side of the dielectric substrate and the plurality of conductive patches are disposed on a backside of the dielectric substrate.

In yet another embodiment, the circular patch includes one or more elongated sections extending radially outward from the circular patch. Each of the one or more elongated sections is coupled to the output of a corresponding microstrip, and each microstrip is disposed radially outward beyond an end of an associated one of the one or more elongated sections.

In accordance with another embodiment, a circularly polarized antenna includes a dielectric substrate, a circular patch overlying the dielectric substrate, a first conductive ring surrounding the circular patch and overlying the dielectric substrate, one or more antenna feeds coupled to the circular patch, and a metamaterial ground plane. The first conductive ring is coupled to ground and isolated from the circular patch. The metamaterial ground plane includes a plurality of conductive patches arranged along a first plane below the circular patch and separated from the circular patch by at least the dielectric substrate. The plurality of conductive patches are arranged in a pattern that provides circular symmetry with respect to a center of the circularly polarized antenna. The metamaterial ground plane also includes a ground plane arranged along a second plane, the ground plane electrically coupled to at least a first portion of the plurality of conductive patches. The first portion of the plurality of conductive patches and the ground plane are coupled to ground.

In accordance with yet another embodiment, an antenna configured to receive radiation at GNSS frequencies includes a dielectric substrate, a circular patch overlying the dielectric substrate, a first conductive ring surrounding the circular patch and overlying the dielectric substrate, one or more impedance transformers, and a metamaterial ground plane. Each of the one or more impedance transformers are coupled to a first input feed and coupled to the circular patch at an output. The metamaterial ground plane includes a plurality of conductive patches and a ground plane. The plurality of conductive patches are arranged along a first plane below the circular patch and are separated from the circular patch and the first conductive ring by at least the dielectric substrate. The plurality of conductive patches are arranged in a pattern that provides circular symmetry with respect to a center of the circularly polarized antenna. The ground plane is arranged along a second plane and is electrically coupled to at least a first portion of the plurality of conductive patches. The first portion of the plurality of conductive patches and the ground plane are coupled to ground.

Numerous benefits are achieved using embodiments described herein over conventional techniques. By having a connected-slot structure with multiple feeds and phasing, a broadband circularly polarized antenna may be obtained. This enables the reception of all GNSS signals, available worldwide, with a single antenna, resulting in significant cost and size savings. For example, some embodiments include connected-slot antennas that have a simple design and a relatively small size so that they can be produced economically. Also, in some embodiments, the connected-slot antennas include a metamaterial ground plane with a plurality of conductive patches that are arranged in a pattern that provides circular symmetry with respect to a center of the antenna. This arrangement of conductive patches can reduce gain variation with azimuth angle, especially at low elevation angles, and improve phase center stability. Additionally, some embodiments may include impedance transformers with microstrips formed on the same plane as the circular patch. This can improve alignment of the antenna features, contribute to phase center stability, and reduce fabrication costs. Also, some embodiments may include a discontinuous ring comprising discrete conductive elements surrounding a circular patch. This can increase antenna gain in GNSS frequency bands and increase antenna bandwidth. Depending on the embodiment, one or more of these features and/or benefits may exist. These and other features and benefits are described throughout the specification with reference to the appended drawings.

DETAILED DESCRIPTION

Embodiments described herein provide circularly polarized connected-slot antennas. In some embodiments, the connected-slot antennas include a metamaterial ground plane that includes conductive patches arranged in a pattern that provides circular symmetry with respect to a center of the connected-slot antennas. In some embodiments, the connected-slot antennas may be configured to operate over a wide bandwidth so that they can receive radiation at different GNSS frequencies.

Figure 1:
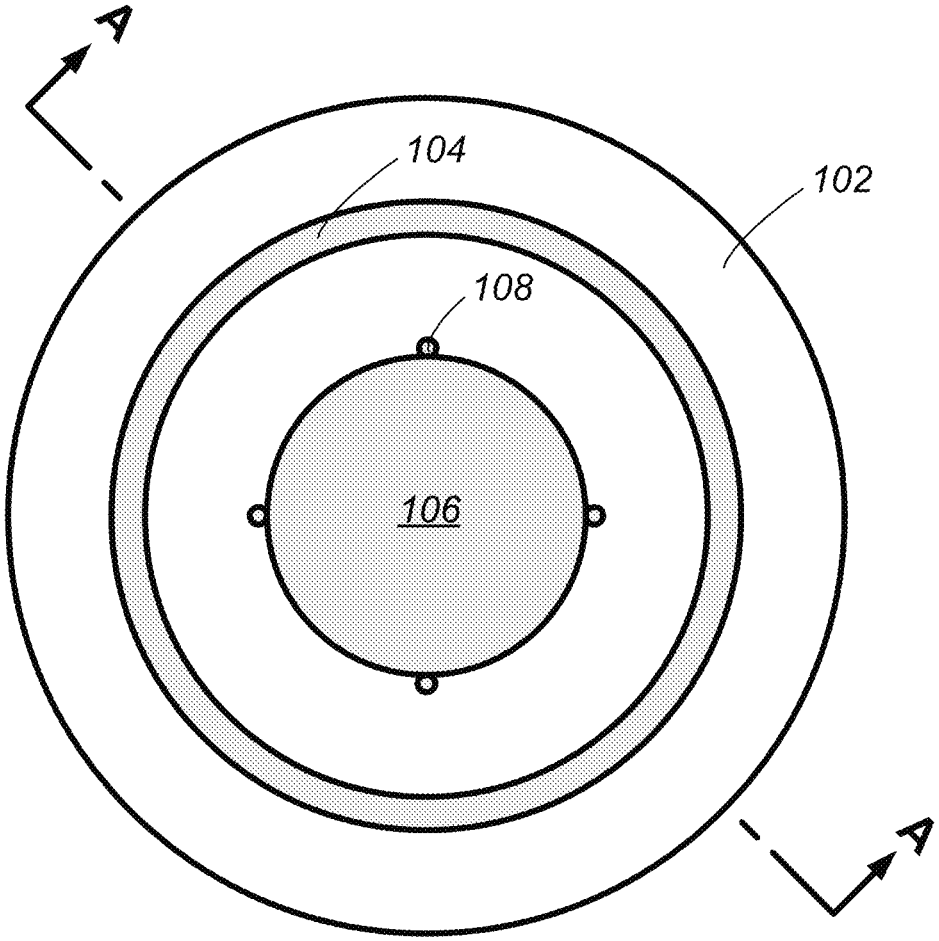
FIG. 1 is a simplified top view of a connected-slot antenna in accordance with an embodiment.

FIG. 1 is a simplified top view of a connected-slot antenna in accordance with an embodiment. A circular patch 106 overlies a dielectric substrate 102. A conductive ring 104 also overlies the dielectric substrate 102 and surrounds the circular patch 106. The portion of the dielectric substrate 102 that extends between the circular patch 106 and the conductive ring 104 forms a connected slot. The dielectric substrate 102 provides electrical isolation between the circular patch 106 and conductive ring 104, both of which are electrically conducting.

The dielectric substrate 102 may comprise a non-conductive material such as a plastic or ceramic. The circular patch 106 and the conductive ring 104 may comprise a conductive material such as a metal or alloy. In some embodiments, the dielectric material may include a non-conductive laminate or pre-preg, such as those commonly used for printed circuit board (PCB) substrates, and the circular patch 106 and the conductive ring 104 may be etched from a metal foil in accordance with known PCB processing techniques.

In some embodiments, the circular patch 106 and the conductive ring 104 each have a substantially circular shape, and diameters of the circular patch 106 and the conductive ring 104, as well as a distance between the circular patch 106 and the conductive ring 104, may be determined based on a desired radiation pattern and operating frequency. In an embodiment, the dielectric substrate 102 is substantially the same shape as the conductive ring 104 and has a diameter that is the same as or greater than an outside diameter of the conductive ring 104. The circular patch 106 and/or dielectric substrate 102 may be substantially planar in some embodiments or have a slight curvature in other embodiments. The slight curvature can improve low elevation angle sensitivity.

The connected-slot antenna in this example also includes four feeds 108 that are disposed in the connected slot and coupled to the circular patch 106. Other embodiments may include a different number of feeds (more or less). The feeds 108 provide an electrical connection between the circular patch 106 and a transmitter and/or receiver. The feeds 108 are disposed around a circumference of the circular patch 106 so that each feed 108 is spaced from adjacent feeds 108 by approximately equal angular intervals. The example shown in FIG. 1 includes four feeds 108, and each of the feeds 108 are spaced from adjacent feeds 108 by approximately 90°. For a connected-slot antenna with six feeds, the angular spacing would be approximately 60°; for a connected-slot antenna with 8 feeds, the angular spacing would be approximately 45°; and so on.

The placement of the feeds 108 around the circular patch 106 allows the feeds 108 to be phased to provide circular polarization. For example, signals associated with the four feeds 108 shown in FIG. 1 may each have a phase that differs from the phase of an adjacent feed by +90° and that differs from the phase of another adjacent feed by −90°. In an embodiment, the feeds are phased in accordance with known techniques to provide right hand circular polarization (RHCP). The number of feeds may be determined based on a desired bandwidth of the connected-slot antenna.

Figure 2:
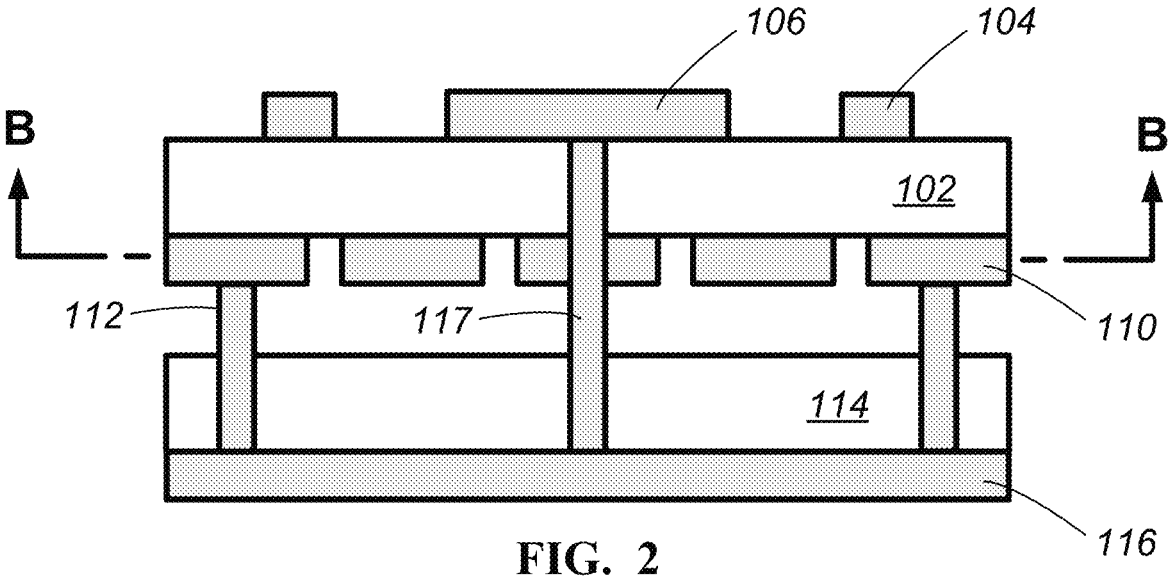
FIG. 2 is a simplified cross section along line A-A of the connected-slot antenna shown in FIG. 1 in accordance with an embodiment.

FIG. 2 is a simplified cross section along line A-A of the connected-slot antenna shown in FIG. 1 in accordance with an embodiment. This figure provides a cross-section view of the circular patch 106, the conductive ring 104, and the dielectric substrate 102. This figure shows a gap separating the circular patch 106 from the conductive ring 104. The gap may include air or another dielectric that provides electrical isolation between the circular patch 106 and the conductive ring 104.

This cross section also shows that the connected-slot antenna in this example includes conductive patches 110 disposed on a backside of the dielectric substrate 102. The conductive patches 110 are arranged along a first plane below the circular patch 106 and separated from the circular patch 106 by the dielectric substrate 102. The conductive patches 110 may be separated from adjacent conductive patches 110 by a dielectric (e.g., air or another dielectric).

Figure 30:
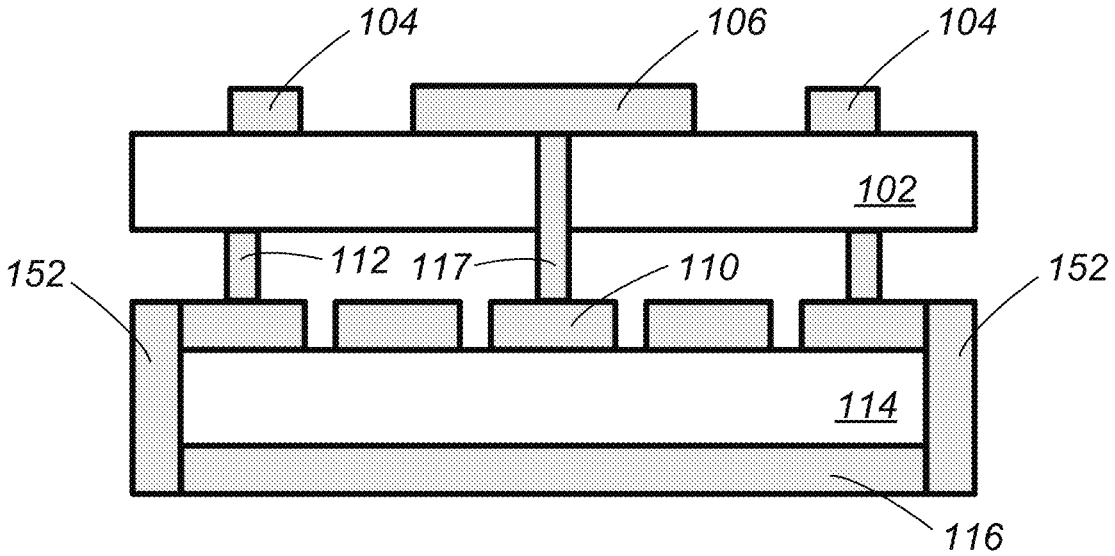

In some embodiments, the conductive patches 110 may be separated from the circular patch 106 and the conductive ring 104 by one or more additional dielectrics as well. As an example, the conductive patches 110 may be disposed on a top surface of dielectric 114 (as shown in FIG. 30) so that they are separated from the circular patch 106 and the conductive ring 104 by the dielectric substrate 102 plus another dielectric (e.g., air or another dielectric filling the gap between the dielectric substrate 102 and the dielectric 114). In yet other embodiments, the conductive patches 110 may be coupled to a backside of the dielectric substrate 102 and to a front side of the dielectric 114 (eliminating the gap).

FIG. 2 also shows a ground plane 116 that is electrically grounded and coupled to a first portion of the conductive patches 110 by first vias 112 and electrically isolated from a second portion of the conductive patches 110. In this example, the ground plane 116 is also coupled to one of the conductive patches 110 and to the circular patch 106 by a second via 117. As shown in FIG. 1, the circular patch 106 is coupled to the feeds 108 along a perimeter of the circular patch 106 to provide an active (radiating) element, and a center of the circular patch 106 may be coupled to ground by the second via 117.

The conductive patches 110, the first vias 112, the second via 117, and the ground plane 116 form a metamaterial ground plane. The metamaterial ground plane can provide an artificial magnetic conductor (AMC) with electromagnetic band-gap (EBG) behavior. This allows the metamaterial ground plane to be disposed at a distance of less than $\lambda/4$ from the circular patch 106 and the conductive ring 104 while still providing a constructive addition of the direct and reflected waves over the desired frequencies (e.g., 1.1-2.5 GHz). In some embodiments, the metamaterial ground plane also provides surface wave suppression and reduces left hand circular polarized (LHCP) signal reception to improve the multipath performance over a wide bandwidth. With the metamaterial ground plane, antenna gain can be on the order of 7-8 dBi, with strong radiation in the upper hemisphere including low elevation angles, and negligible radiation in the lower hemisphere for enhanced multipath resilience.

The conductive patches 110, the first vias 112, the second via 117, and the ground plane 116 may comprise a conductive material such as a metal or alloy. In an embodiment, the conductive patches 110 and the ground plane 116 may be etched from a metal foil in accordance with known PCB processing techniques. The first vias 112 and the second via 117 may comprise a metal pin (solid or hollow) or may be formed using a via etch process that forms via holes through the dielectrics and then deposits a conductive material in the via holes.

The dielectric 114 may comprise an electrically non-conductive material such as a plastic or ceramic. In some embodiments, the dielectric 114 may include a non-conductive laminate or pre-preg, such as those commonly used as for PCB substrates.

Figure 28:
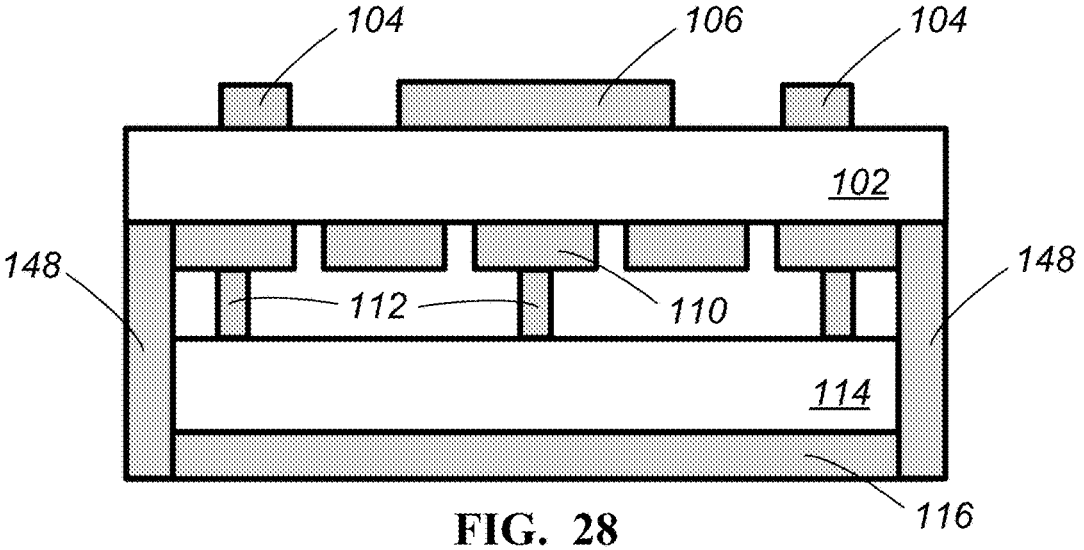
Figure 29:
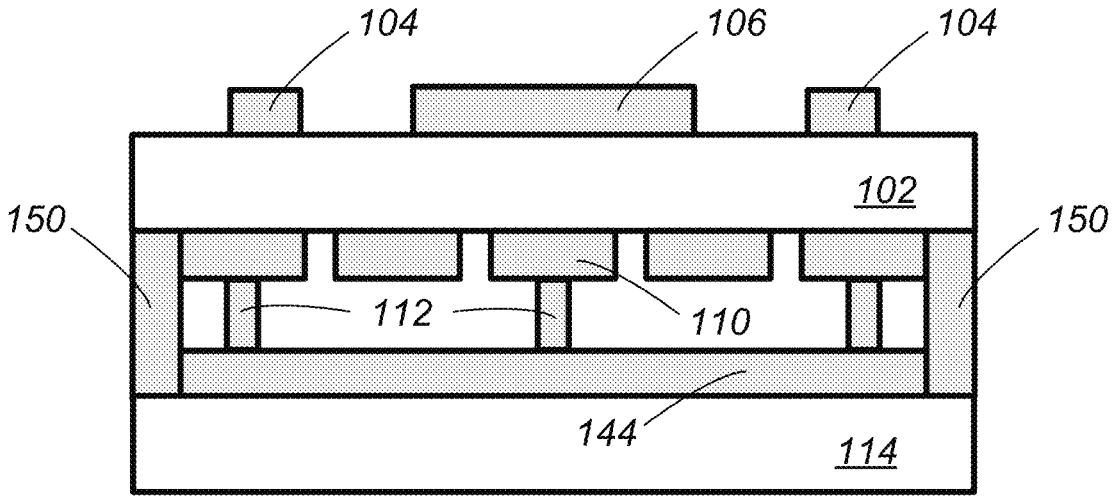

In some embodiments, the second via 117 may extend only from the ground plane 116 to one of the conductive patches 110 in a manner similar to the first vias 112 in this example (rather than also extending through the dielectric substrate 102 to the circular patch 106). Examples of the center via extending only from the ground plane to one of the conductive patches are shown in FIGS. 28-29, where a via 112 extends only to one of the conductive patches 110. In these embodiments, the circular patch 106 is not coupled to ground. Connection between the circular patch and ground may not be necessary in some embodiments.

These different configurations are provided merely as examples, and each of the examples shown in FIGS. 2 & 26-30 may include (i) a second via that extends through the dielectric substrate and is coupled to the circular patch; (ii) a center via that extends only from the ground plane to one of the conductive patches; or (iii) no center via. In some embodiments, the vias provide structural support, and the particular configuration of the vias is determined at least in part based on desired structural features.

Also, in some embodiments, each of the conductive patches 110 may be coupled to the ground plane 116 using additional vias (instead of only some of the conductive patches 110 being coupled to the ground plane 116 as shown in the figures). Further, in some embodiments, the first vias 112 may extend through the dielectric substrate 102 like the second via 117. In these embodiments, the first vias 112 may either be coupled to the conductive ring 104 or may be isolated from the conductive ring 104.

Figure 3:
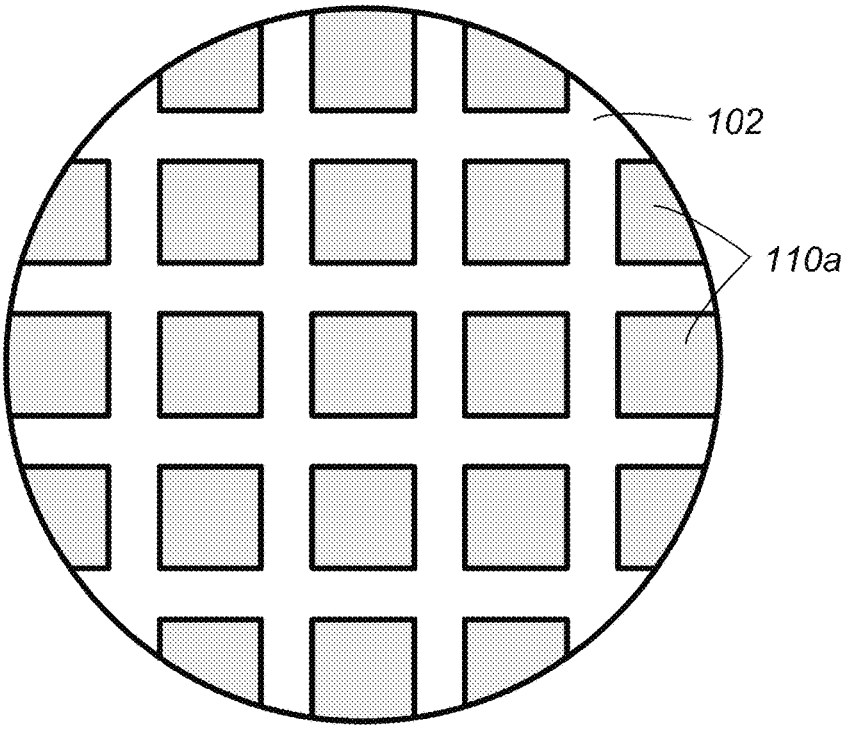
FIGS. 3-4 and 5*a*-5*b* are simplified views along line B-B of the connected-slot antenna shown in FIG. 2 in accordance with some embodiments.
Figure 4:
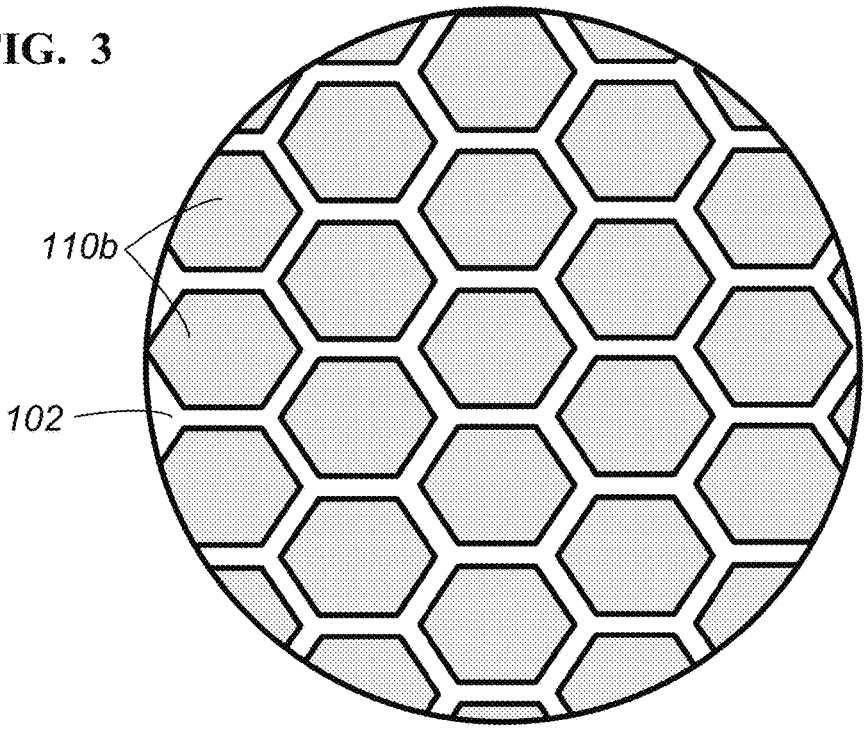

FIGS. 3-4 and 5*a*-5*b* are simplified bottom views along line B-B of the connected-slot antenna shown in FIG. 2 in accordance some embodiments. FIG. 3 shows an array of conductive patches 110*a* each having a square-shape, and FIG. 4 shows a honeycomb arrangement of conductive patches 110*b* each having a hexagon-shape.

Figure 5A:
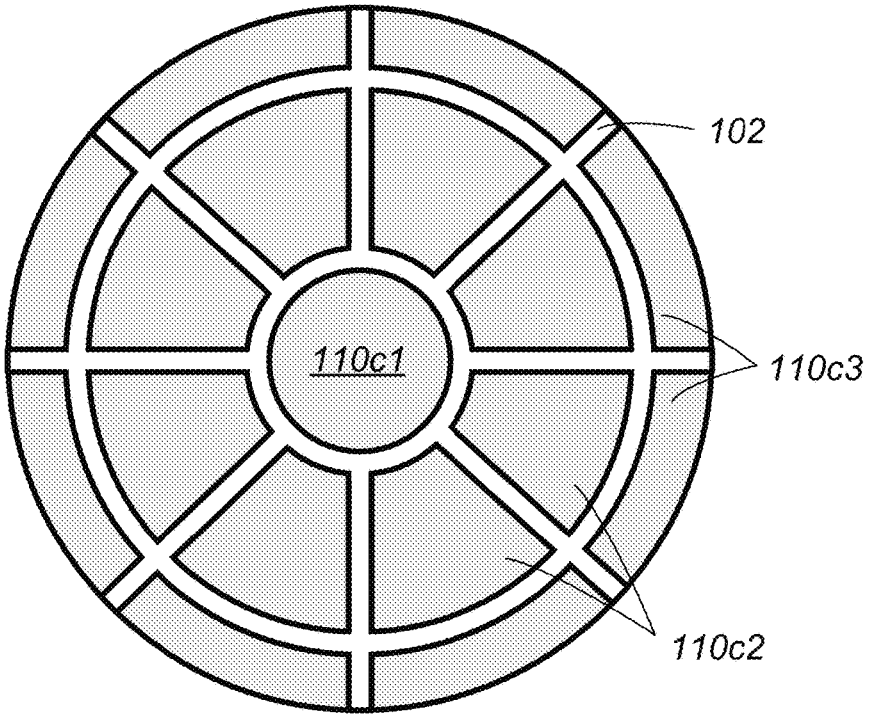

FIG. 5*a* shows an arrangement that includes a center conductive patch 110*c*1, intermediate conductive patches 110*c*2, and outer conductive patches 110*c*3. The center conductive patch 110*c*1 is surrounded in a radial direction by the intermediate conductive patches 110*c*2, and the intermediate conductive patches 110*c*2 are surrounded in a radial direction by the outer conductive patches 110*c*3. These conductive patches 110*c*1, 110*c*2, 110*c*3 can be aligned with the feeds (e.g., feeds 108 in FIG. 1) so that one of the intermediate conductive patches 110*c*2 is on an opposite side of the dielectric substrate 102 from each feed.

This arrangement provides conductive patches arranged in a pattern that provides circular symmetry with respect to a center (or phase center) of the antenna. The conductive patches 110*c*1, 110*c*2, 110*c*3 provide circular symmetry by having equal distances between a center of the conductive patch 110*c*1 and any point along curved inner edges of the intermediate conductive patches 110*c*2, between the center and any point along curved outer edges of the intermediate conductive patches 110*c*2, between the center and any point along curved inner edges of the outer conductive patches 110*c*3, and between the center and any point along curved outer edges of the outer conductive patches 110*c*3. Thus, all paths are the same that pass radially outward from a center of the center conductive patch 110*c*1 and through the intermediate and outer conductive patches 110*c*2, 110*c*3. The circular symmetry can reduce variation in gain and improve phase center stability, particularly for low angle signals.

Figure 5B:
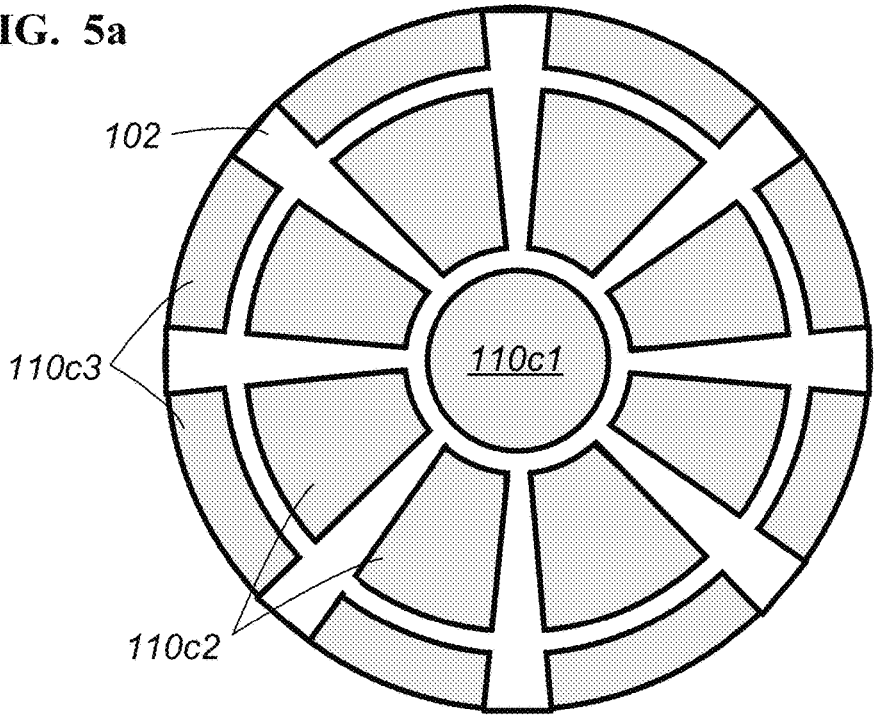

FIG. 5*b* is similar to FIG. 5*a*, except a width of the radial spacing between adjacent conductive patches increases with distance from the center. Similarly, the spacing between the intermediate conductive patches 110*c*2 and the center conductive patch 110*c*1 may be different than the spacing between the outer conductive patches 110*c*3 and the intermediate conductive patches 110*c*2.

Any number of intermediate conductive patches 110*c*2 and outer conductive patches 110*c*3 can be used. The number may be based on a number of feeds in some embodiments. For example, there may be a corresponding intermediate conductive patch 110*c*2 for each feed. The number of intermediate conductive patches 110*c*2 may be equal to the number of feeds in some embodiments. In other embodiments, the number of intermediate conductive patches 110*c*2 may be greater than the number of feeds. For example, the embodiments shown in FIGS. 5*a*-5*b* include eight intermediate conductive patches 110*c*2, and may be used with antennas that have eight feeds in some embodiments, four feeds in other embodiments, and two feeds in yet other embodiments.

Figure 6:
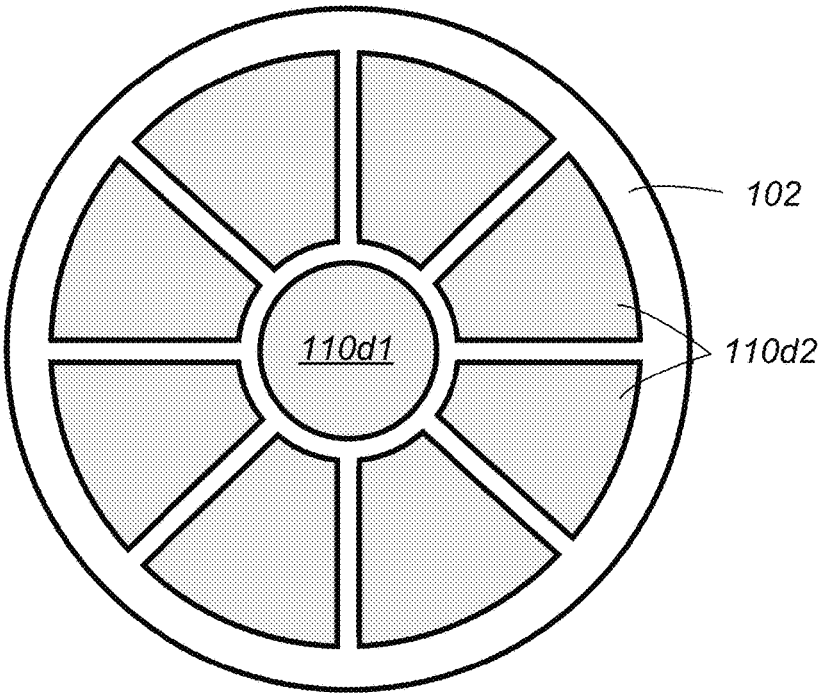
FIGS. 6-8 are simplified views of conductive patches for slot antennas in accordance with some embodiments.
Figure 7:
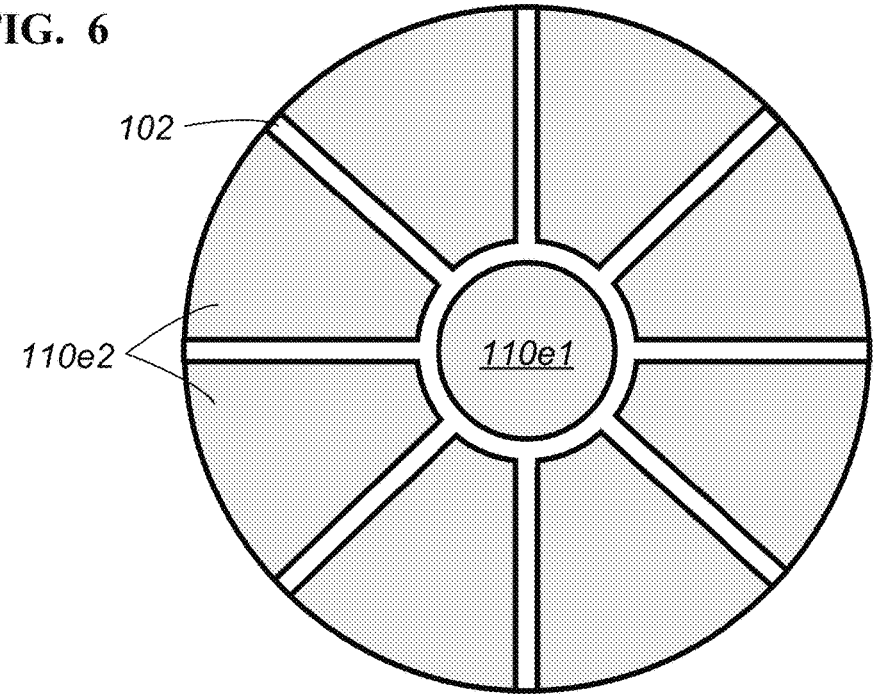
Figure 8:
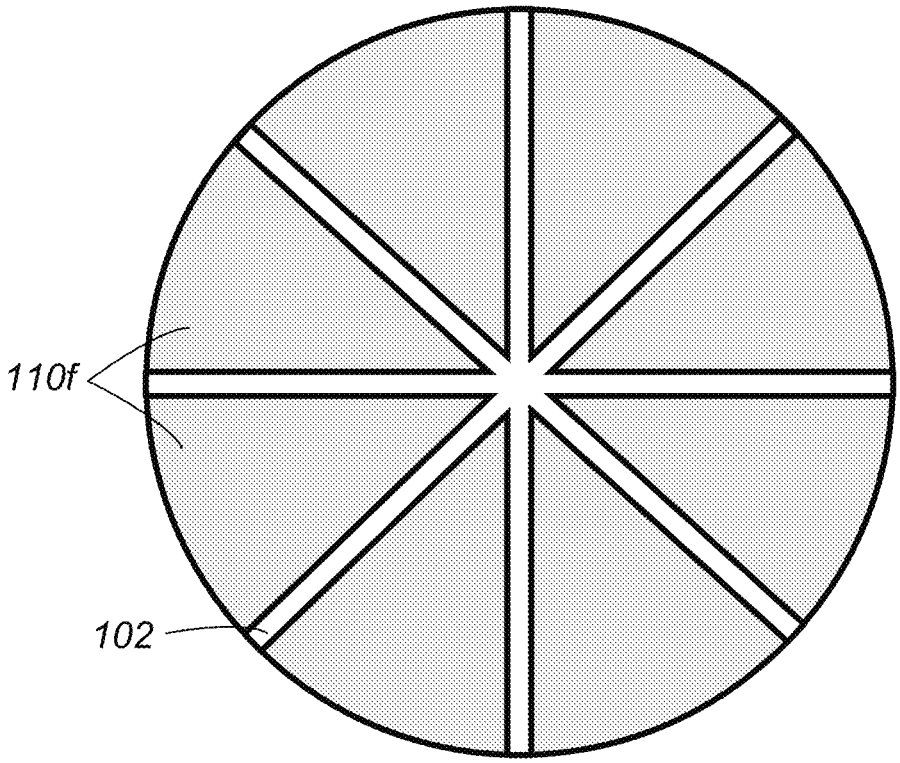

FIGS. 6-8 are simplified views of conductive patches for slot antennas in accordance with other embodiments. FIG. 6 shows an arrangement that includes a center conductive patch 110*d*1 and surrounding conductive patches 110*d*2. This arrangement is similar to that shown in FIGS. 5*a*-5*b* in that it provides circular symmetry with respect to a center (or phase center) of the antenna. This arrangement is different than that shown in FIGS. 5*a*-5*b* in that it does not include outer conductive patches. The center conductive patch 110*d*1 is surrounded in a radial direction by the intermediate conductive patches 110*d*2. In embodiments that include a conductive fence (described below), the outer conductive patches 110*c*3 shown in FIGS. 5*a*-5*b* may be electrically coupled to the conductive fence to provide a short to ground. In FIG. 6, the surrounding conductive patches 110*d*2 do not extend to an edge of the dielectric substrate 102 and thus are not electrically coupled to another conductor along an edge of the dielectric substrate 102.

FIG. 7 shows an arrangement that includes a center conductive patch 110*e*1 and intermediate conductive patches 110*e*2. In this example, the intermediate conductive patches 110*e*2 extend to an edge of the substrate 102 and, if a conductive fence is included, the intermediate conductive patches 110*e*2 may be electrically coupled to it.

FIG. 8 is similar to FIG. 7, but it does not include a center conductive patch. FIG. 8 only includes conductive patches 110*f* that extend from near a center of the substrate 102 to an edge of the substrate 102. In other embodiments, the conductive patches 110*f* may not extend to the edge in a manner similar to FIG. 6. Each of the examples shown in FIGS. 7-8 are similar to the examples shown in FIGS. 5*a*, 5*b*, and 6 in that they provide circular symmetry with respect to a center (or phase center) of the antenna. In addition to providing circular symmetry, these examples allow similar alignment between the conductive patches and feeds (or between the conductive patches and the ground pads associated with the microstrips (described below).

FIGS. 3-8 are provided merely as examples, and the conductive patches 110 are not limited to these particular shapes. Each of the conductive patches 110 may have a different shape and, in some embodiments, the conductive patches may include, or function as, a ground pad (described below). The shape, arrangement, and spacing of the conductive patches 110 may be determined in accordance with known techniques based on desired operating characteristics. The conductive patches 110 shown in these examples may be used with any of the connected-slot antennas described herein.

Figure 9:
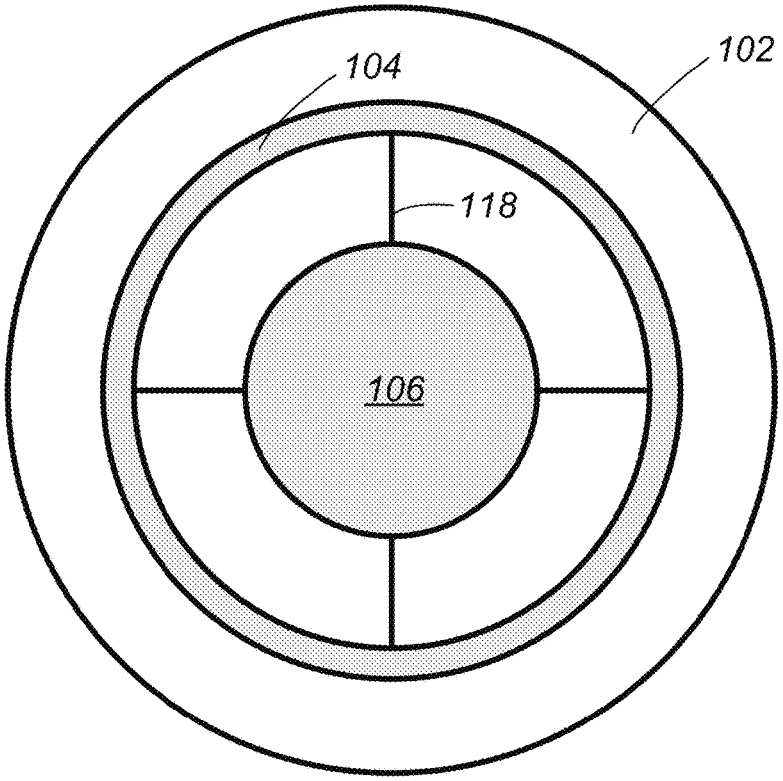
FIG. 9 is a simplified top view of a connected-slot antenna in accordance with an embodiment.

FIG. 9 is a simplified top view of a connected-slot antenna in accordance with another embodiment. This embodiment is similar to the example shown in FIG. 1 in that it includes a circular patch 106 and conductive ring 104 overlying a dielectric substrate 102. The feeds 118 in this example are different in that they include a conductive line (or trace) overlying the dielectric substrate. This arrangement facilitates use of transmission lines such as coaxial cables, each having a core coupled to the circular patch 106 and a ground coupled to the conductive ring 104. An opposite end of each transmission line is coupled to a transmitter and/or receiver. In some embodiments, the core may be coupled directly to the circular patch 106 and isolated from the feeds 118, and the feeds 118 may couple the ground to the conductive ring 104. In other embodiments, the ground may be coupled directly to the conductive ring 104 and isolated from the feeds 118, and the feeds 118 may couple the core to the conductive patch 106.

Like the example shown in FIG. 1, the feeds 118 are disposed around a circumference of the circular patch 106 so that each feed 118 is spaced from adjacent feeds 118 by approximately equal angular intervals. In this example, each of the four feeds 118 are spaced from adjacent feeds 118 by approximately 90°.

The feeds 118 in this example may comprise a conductive material such as a metal or alloy. In an embodiment, the feeds 118 may be etched from a metal foil in accordance with known PCB processing techniques. The circular patch 106, conductive ring 104, and dielectric substrate 102 may be arranged in a manner similar to that described above with regard to FIG. 1. This embodiment may also include any of the other features described above with regard FIG. 2 and described below with regard to FIGS. 26-32 (e.g., conductive patches, vias, ground plane, conductive fence, etc.).

Figure 10A:
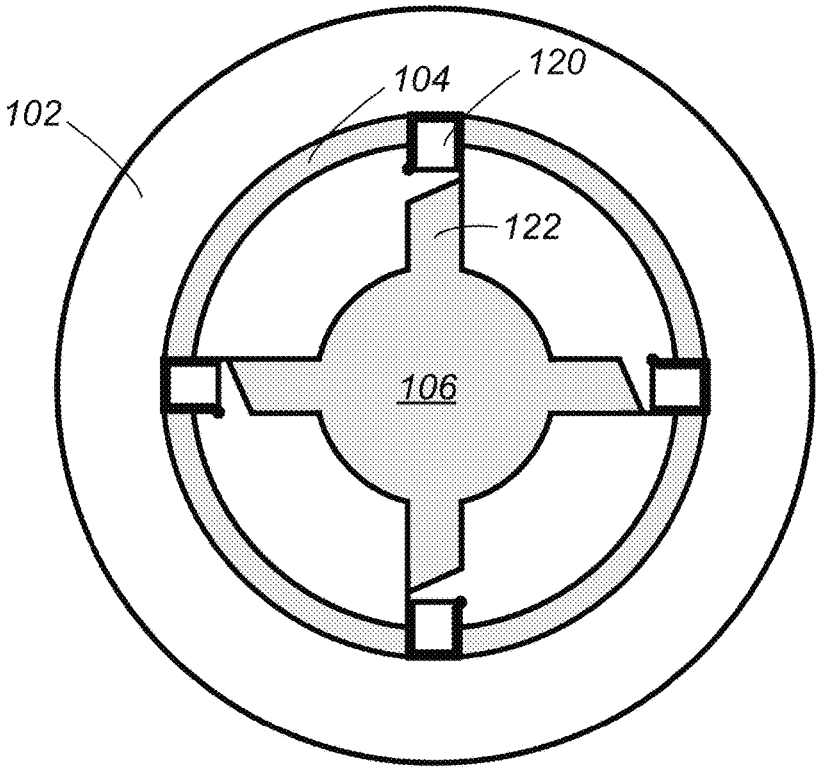
FIG. 10*a* is a simplified top view of a connected-slot antenna in accordance with another embodiment.

FIG. 10*a* is a simplified top view of a connected-slot antenna in accordance with another embodiment. This embodiment is similar to the example shown in FIG. 1 in that it includes a circular patch 106 and a conductive ring 104 overlying a dielectric substrate 102. This embodiment is different from the example shown in FIG. 1 in that the antenna feeds include impedance transformers 120. The impedance transformers 120 perform load matching between an input and the antenna structure. In an embodiment, for example, a typical impedance at an input of a transmission line (e.g., a coaxial cable) may be approximately 50Ω, and an impedance of the antenna may be higher (e.g., approximately 100Ω, 200Ω, or more). Each impedance transformer 120 can be configured to convert the impedance of the input to the impedance of the antenna.

In the example shown in FIG. 10*a*, the conductive patch 106 also includes elongated sections 122 extending radially outward from a circular portion of the conductive patch 106. Each elongated section 122 is spaced from adjacent elongated sections 122 by approximately equal angular intervals. Each elongated section 122 is positioned adjacent to an output of one of the impedance transformers 120. The elongated sections 122 provide a connection between the output of the impedance transformers 120 and the conductive patch 106. The elongated sections 122 shown in FIG. 10*a* are provided merely as examples, and other embodiments that include elongated sections may use different sizes and shapes of elongated sections. The elongated sections 122 may comprise a conductive material such as a metal or alloy. In an embodiment, the elongated sections 122 may be etched from a metal foil in accordance with known PCB processing techniques.

Figure 10B:
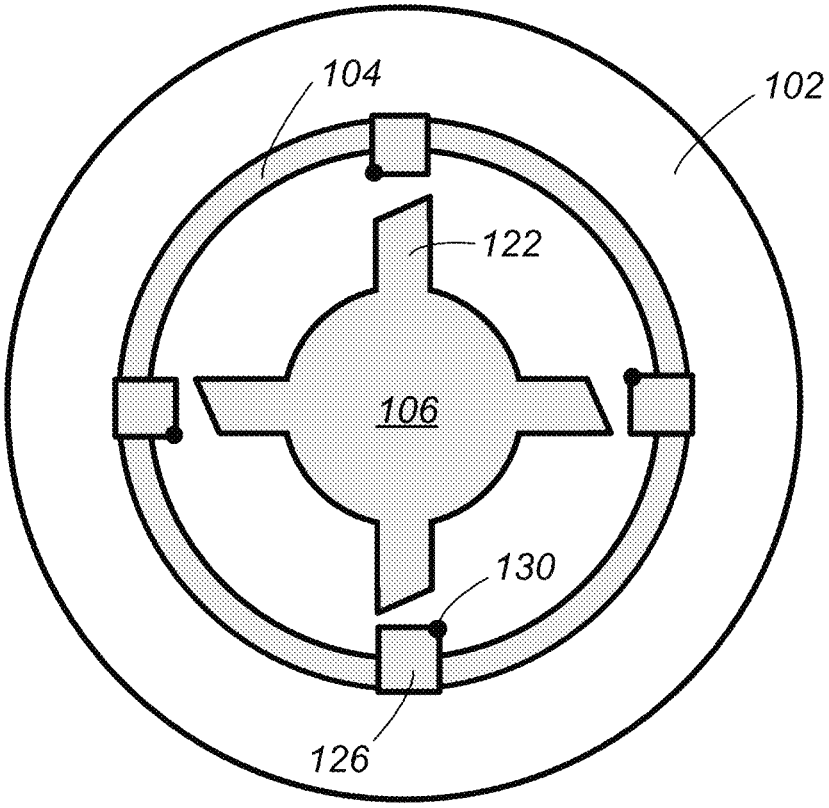
FIGS. 10*b*-10*c* are simplified top views of portions of the connected-slot antenna shown in FIG. 10*a* in accordance with some embodiments.

In an embodiment, the impedance transformers 120 each include a microstrip and ground pad that are separated by a dielectric. These features can be illustrated with reference to FIGS. 10*b*-10*c*, which are simplified top views of portions of the connected-slot antenna shown in FIG. 10*a* in accordance with some embodiments. In FIG. 10*b*, the microstrip and dielectric of the impedance transformers 120 are removed to expose ground pads 126. The ground pads 126 are electrically coupled to the conductive ring 104. Each ground pad 126 may include a small ring 130 for connection to ground. If a coaxial cable is used as a transmission line, a ground (or shield) may be coupled to the ground pad 126 at the small ring 130. This is shown and explained further with regard to FIG. 11.

Figure 10C:
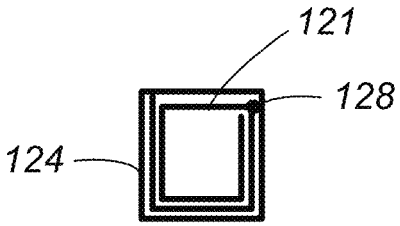

FIG. 10*c* shows a microstrip 121 on a dielectric 124. The microstrip 121 and dielectric 124 are configured to overly each of the ground pads 126. Each microstrip 121 and ground pad 126 are conductive, and the dielectric 124 provides electrical isolation between the microstrip 121 and ground pad 126. Each microstrip 121 includes an input 128 for connection to a feed. If a coaxial cable is used as a transmission line, a core may be coupled to the input 128. Each microstrip 121 includes at least two conductive traces. This is shown and explained further below with regard to FIGS. 12-16.

The ground pads 126 and microstrips 121 may comprise a conductive material such as a metal or alloy. In an embodiment, the ground pads 126 and microstrips 121 may be etched from a metal foil in accordance with known PCB processing techniques.

The circular patch 106, conductive ring 104, and dielectric substrate 102 may be arranged in a manner similar to that described above with regard to FIG. 1. This embodiment may also include any of the other features described above with regard to FIG. 2 and described below with regard to FIGS. 26-32 (e.g., conductive patches, vias, ground plane, conductive fence, etc.).

Figure 11:
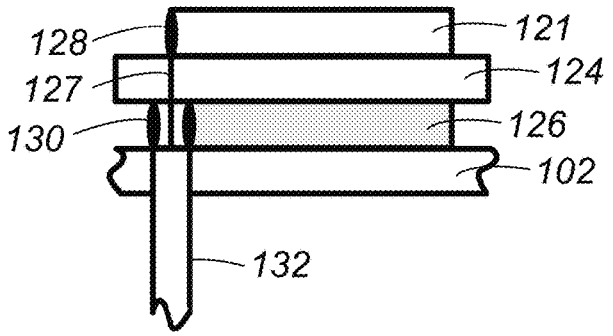
FIGS. 11-17 are simplified diagrams of impedance transformers, or portions of impedance transformers, in accordance with some embodiments.

FIG. 11 is a simplified cross section of an impedance transformer in accordance with an embodiment. A dielectric 124 (dielectric plate) separates the microstrip 121 from the ground pad 126. A transmission line 132 (e.g., a coaxial cable) extends through the dielectric substrate 102. The transmission line 132 includes a ground (or shield) that is coupled to the ground pad 126 at the small ring 130 and a core 127 that extends through the dielectric 124 and is coupled to the microstrip 121 at the input 128.

Figure 12:
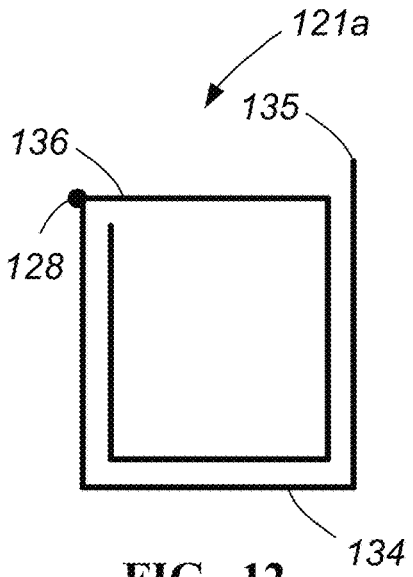
Figure 13:
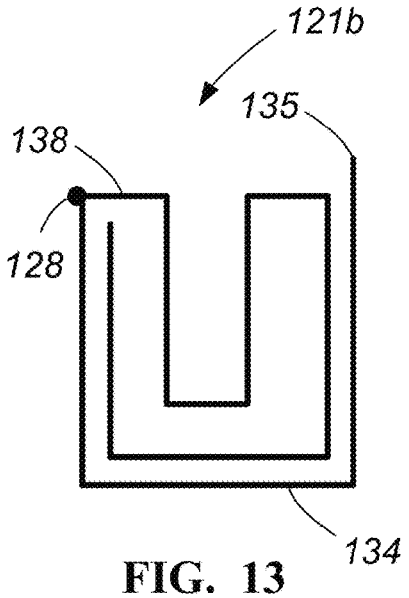
Figure 14:
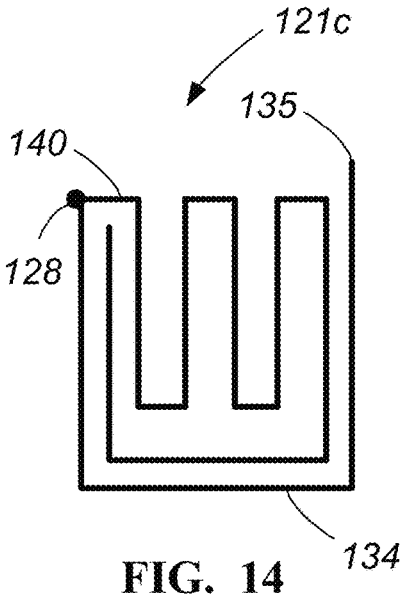

FIG. 12 is a simplified top view of a microstrip 121*a* in accordance with an embodiment. The microstrip 121*a* includes two conductive traces 134, 136. The first conductive trace 134 has one end coupled to an input 128 and another end coupled to an output 135. The input 128 is coupled to a feed (e.g., from a transmission line), and the output 135 is coupled to a conductive patch (e.g., conductive patch 106). The second conductive trace 136 has one end coupled to the input 128 and another end that is free from connection with a conductor. The first and second conductive traces 134, 136 may extend substantially parallel to but separate from each other along multiple sections of the microstrip 121*a*. In this example, each section extends substantially perpendicular to an adjacent section.

Figure 15:
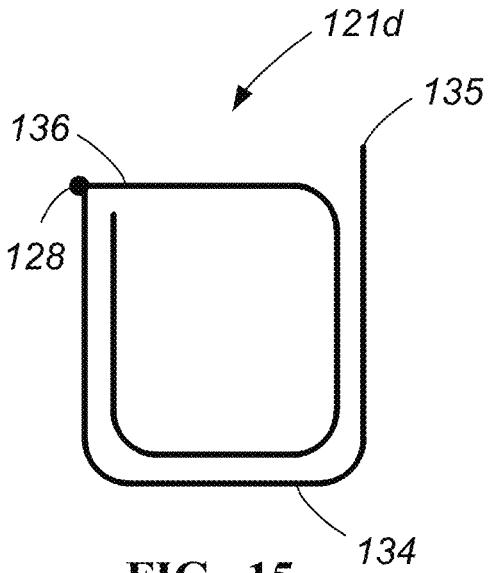
Figure 16:
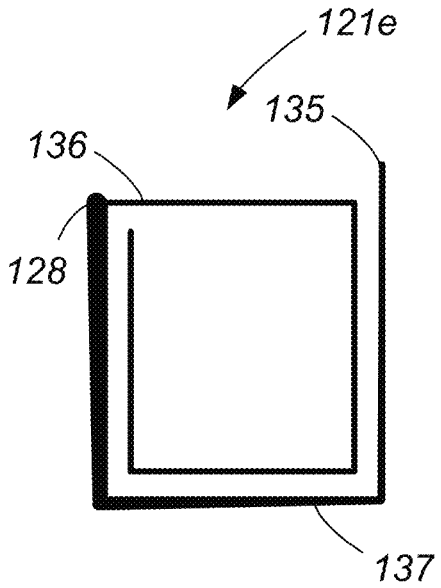

FIGS. 13-16 are simplified top views of microstrips in accordance with other embodiments. In the example shown in FIG. 13, a second conductive trace 138 of microstrip 121*b* is longer than the example shown in FIG. 12. The second conductive trace 138 has additional sections that extend parallel to other sections. In the example shown in FIG. 14, a second conductive trace 140 of microstrip 121*c* is longer than the example shown in FIG. 13. The second conductive trace 140 has even more sections that extend parallel to other sections. FIG. 15 is a simplified top view of a microstrip 121*e* in accordance with another embodiment. This example is similar to that of FIG. 12 but with rounded corners instead of sharper corners. FIG. 16 is a simplified top view of a microstrip 121*d* in accordance with another embodiment. This example is similar to that of FIG. 12 but a width of a first conductive trace 137 at the input 128 is greater than the width at the output 135. Although not shown in this example, a width of the second conductive trace 136 may also decrease from the input 128 to the output 135. In some embodiments, the decreasing width of the traces, or the increasing space between the traces, can increase impedance of the microstrip leading to increased bandwidth of the antenna. This can reduce loss and increase gain.

The different shapes of the traces in FIGS. 12-16 are provided merely as examples, and the microstrips are not intended to be limited to these examples. A length of the two traces, spacing between the traces, and shape of the traces may be determined based on desired matching characteristics.

Figure 17:
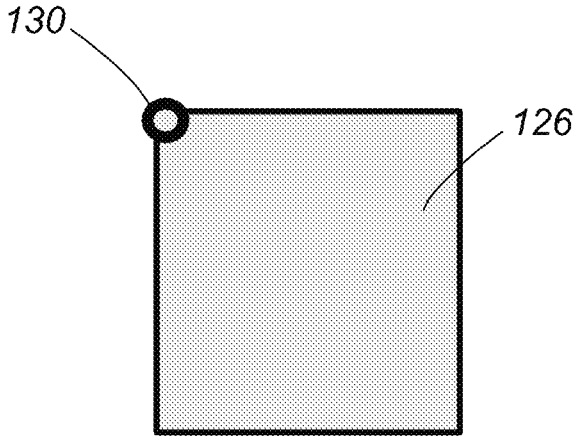

FIG. 17 is a simplified top view of a ground pad 126 in accordance with an embodiment. The ground pad 126 serves as a ground plane for the impedance transformer. This figure shows the small ring 130 for forming an electrical connection with ground. In an embodiment, the ground pad 126 is the same size or slightly larger than the main sections of the associated microstrip 121 and is arranged under the associated microstrip 121. The output 135 of an associated microstrip may extend beyond an edge of the ground pad 126.

Figure 18A:
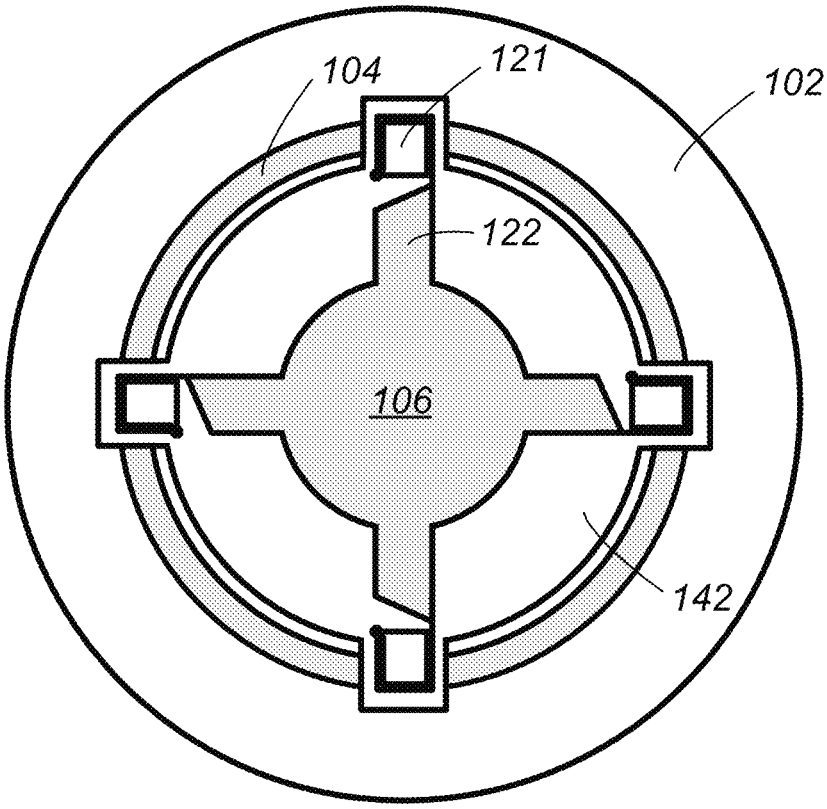
FIG. 18*a* is a simplified top view of a connected-slot antenna in accordance with another embodiment.
Figure 18B:
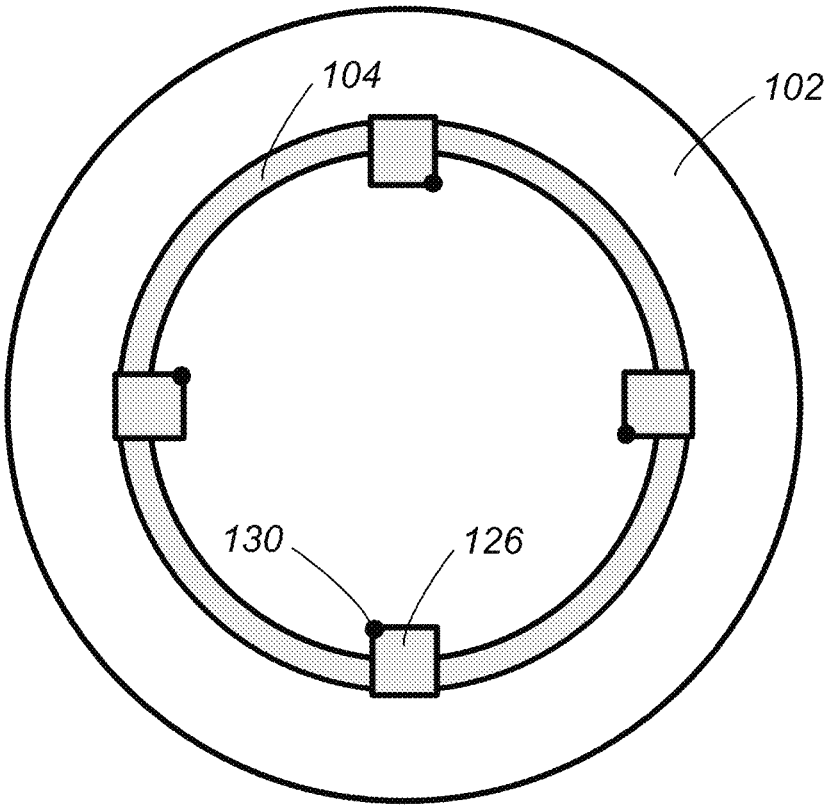
FIGS. 18*b*-18*c* are simplified top views of portions of the connected-slot antenna shown in FIG. 18*a* in accordance with some embodiments.
Figure 18C:
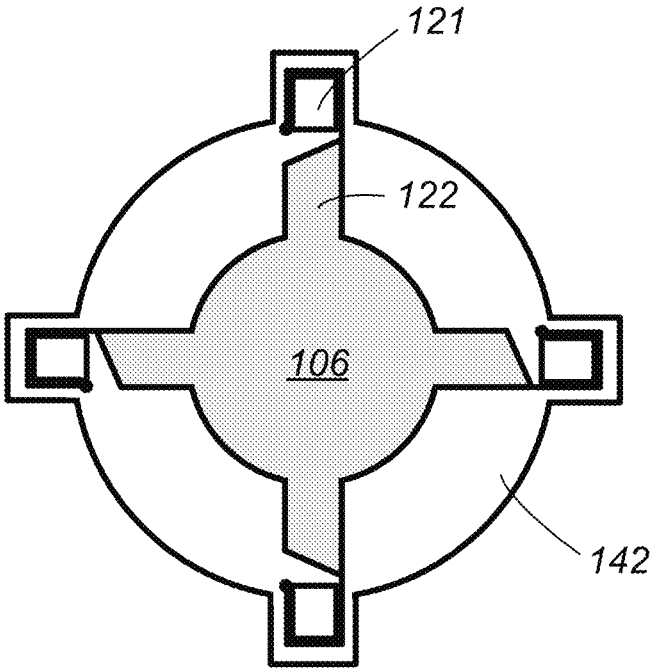

FIG. 18*a* is a simplified top view of a connected-slot antenna in accordance with another embodiment. This embodiment is similar to the embodiment shown in FIG. 10*a*, but a circular patch 106, elongated sections 122, and microstrips 121 overly a dielectric disc 142, and a conductive ring 104 and ground pads 126 overly a dielectric substrate 102. This is shown more clearly in FIGS. 18*b*-18*c*. FIG. 18*b* shows the conductive ring 104 and ground pads 126 overlying the dielectric substrate 102, and FIG. 18*c* shows the circular patch 106, elongated sections 122, and microstrips 121 overlying the dielectric disc 142. In this example, the conductive patches and ground plane (not shown) are separated from the circular patch 106 by at least the dielectric substrate 102 and the dielectric disc 142.

Figure 19:
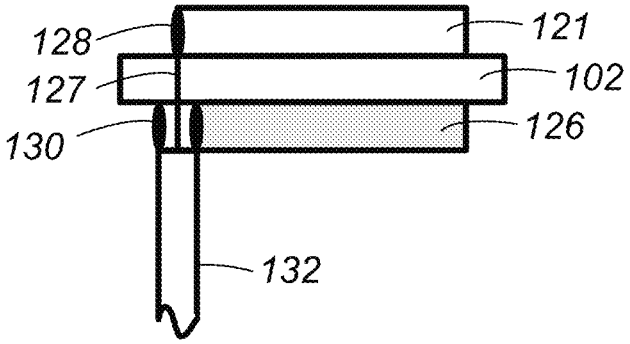
FIG. 19 is a simplified cross section of an impedance transformer in accordance with an embodiment.

FIG. 19 is a simplified cross section of an impedance transformer in accordance with another embodiment. This figure is similar to FIG. 11, but in this example, the ground pad 126 is disposed on a backside of the dielectric substrate 102 so that the dielectric substrate 102 separates the microstrip 121 from the ground pad 126. The transmission line 132 includes a ground (or shield) that is coupled to the ground pad 126 at the small ring 130 and a core 127 that extends through the dielectric substrate 102 and is coupled to the microstrip 121 at the input 128. Either of the embodiments shown in FIG. 11 or 19 may be used with any of the connected-slot antennas shown in FIGS. 10*a*, 18*a*, 20, 23, and 26-30.

The example shown in FIG. 19 eliminates the dielectric 124 that is included in the example shown in FIG. 11. This can improve alignment between the various conductive features (e.g., the circular patch, the conductive ring, the microstrip, and/or the ground pad). Improving alignment improves phase center stability and reduces operating frequency variation. In embodiments where the ground pad 126 is aligned with a conductive patch (e.g., one of the conductive patches 110 on the backside of the dielectric substrate 102), the conductive patch may function as or replace the ground pad 126. This is explained more fully below with regard to FIGS. 21-22.

Figure 20:
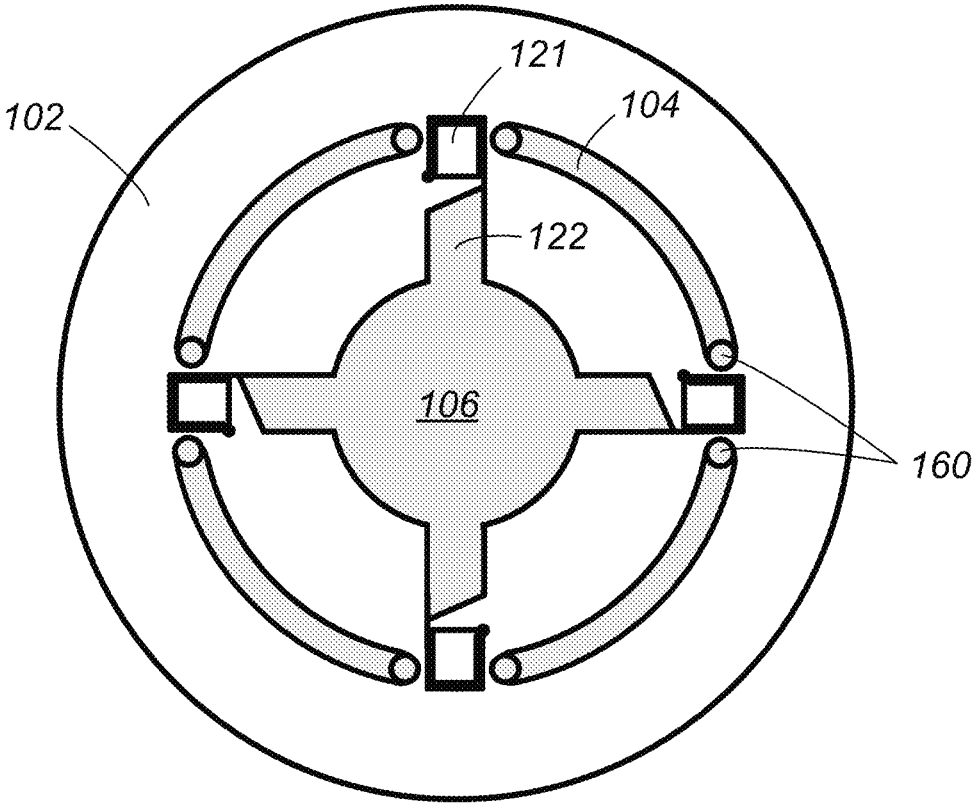
FIG. 20 is a simplified top view of a connected-slot antenna in accordance with another embodiment.

The example shown in FIG. 19 can provide the microstrip 121 and the conductive ring on a same plane (e.g., on a surface of the dielectric substrate 102). If an arrangement of the microstrip 121 and a circumference of the conductive ring are such that the microstrip 121 and conductive ring overlap (as shown in FIG. 10*a*), the conductive ring can be discontinuous across the surface of the dielectric substrate 102 to provide electrical isolation between the conductive ring and microstrip 121. This is shown in FIG. 20, where conductive ring 104 extends along a frontside of dielectric substrate 102 between microstrips 121, and extends along a backside of the dielectric substrate 102 to pass under the microstrips. Portions of the conductive ring on the frontside and the backside of the dielectric substrate 102 may be coupled by conductive vias 160 extending through the dielectric substrate 102.

Portions of the conductive ring extending along the backside of the dielectric substrate 102 may not exist separate from the ground pad 126 and/or the conductive patches (the ground pad 126 and/or the conductive patches may provide electrical continuity with the portions of the conductive ring 104 on the frontside of the dielectric substrate 102). Examples are shown in FIGS. 21-22.

Figure 21:
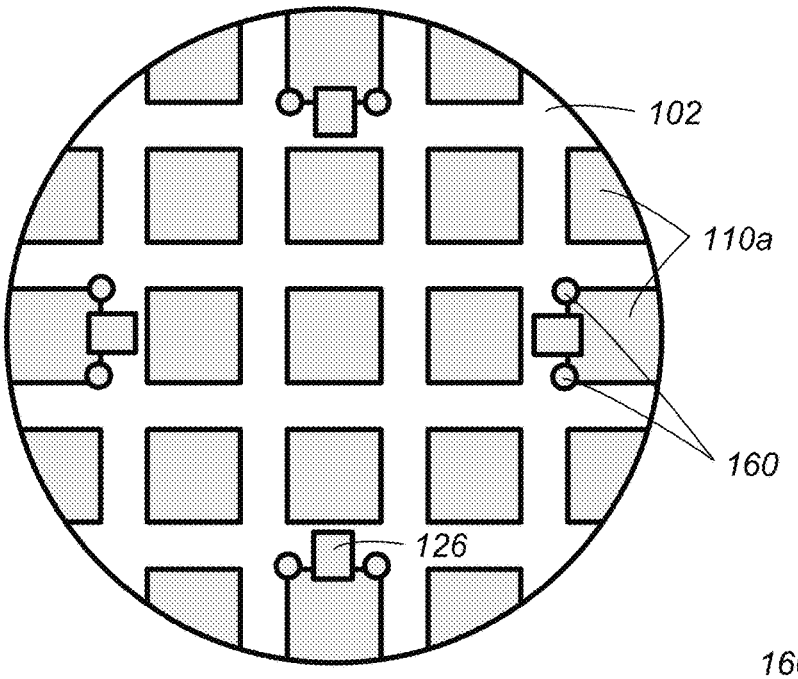
FIGS. 21-22 are simplified views of conductive patches that may be used with the connected-slot antenna shown in FIG. 20 in accordance with some embodiments.

FIG. 21 shows a backside of the dielectric substrate 102. In this example, the backside includes conductive patches 110*a*, conductive vias 160, and ground pads 126. The conductive vias extend through the dielectric substrate 102 to connect with portions of the conductive ring 104 on the frontside of the dielectric substrate 102. The conductive vias 160 and the ground pads 126 overlap with some of the conductive patches 110*a*. The conductive patches 110*a* and the ground pads 126 are conductive and provide electrical continuity between adjacent conductive vias 160 along the backside of the dielectric substrate 102.

Figure 22:
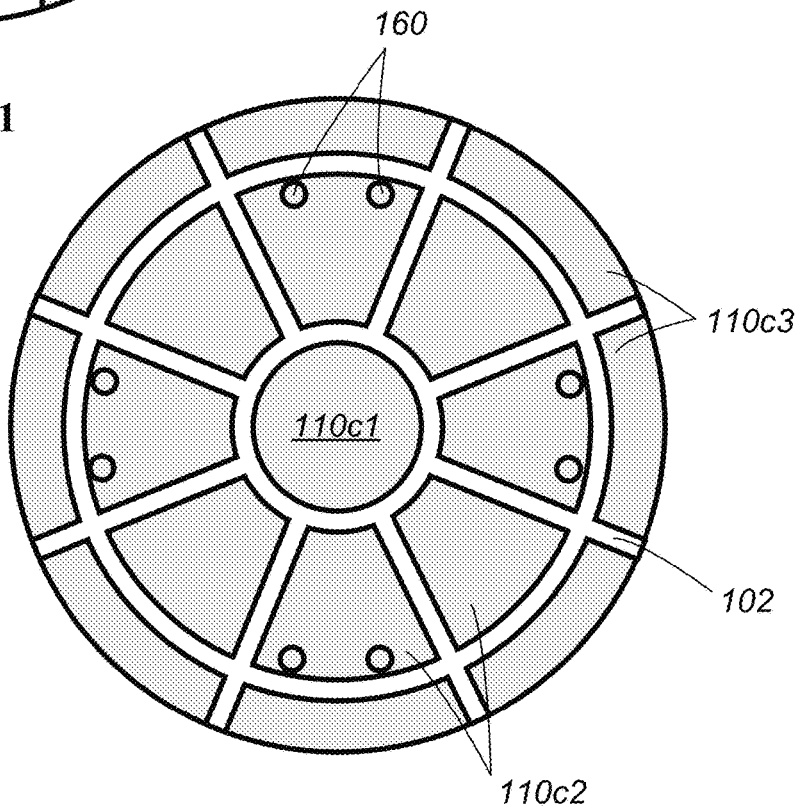

FIG. 22 shows another example where a backside of the dielectric substrate includes conductive patches 110*c*1, 110*c*2, 110*c*3 and conductive vias 160. The conductive vias extend through the dielectric substrate 102 to connect with portions of the conductive ring 104 on the frontside of the dielectric substrate 102. The conductive vias 160 overlap with some of the intermediate conductive patches 110*c*2. In this example, the ground pads completely overlap with some of the intermediate conductive patches 110*c*2 and are not separately shown. The intermediate conductive patches 110*c*2 are conductive and provide electrical continuity between adjacent conductive vias 160 along the backside of the dielectric substrate. Conductive patches having different sizes or shapes (e.g., FIGS. 4 & 6-8) may be utilized in other embodiments. Any of the embodiments shown in FIGS. 20-22 may be used with any of the connected-slot antennas described herein.

Some embodiments may replace the conductive ring with a discontinuous ring. The discontinuous ring is formed by discrete conductive elements on a surface of a dielectric substrate that are connected to ground. The ground connection may be provided by a shield (or ground) of a transmission line or by an electrical connection to a ground plane. Using a discontinuous ring may reduce bandwidth, but it can increase gain in GNSS frequency bands of 1.164-1.30 GHz and 1.525-1.614 GHz.

Figure 23:
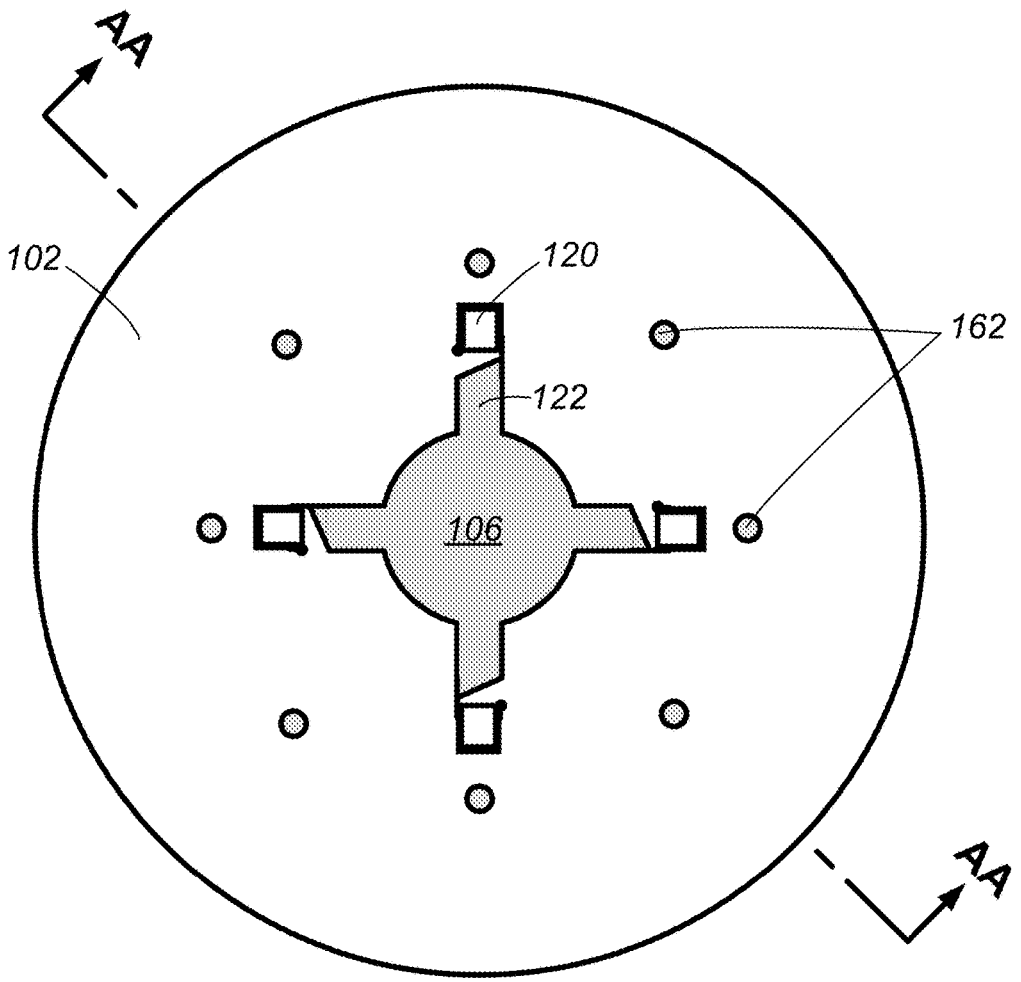
FIG. 23 is a simplified top view of a connected-slot antenna in accordance with another embodiment.

An example of a discontinuous ring is shown in FIG. 23, which is a simplified top view of a connected-slot antenna in accordance with an embodiment. This example includes a circular patch 106 with elongated portions 122 and impedance transformers 120 on a dielectric substrate 102. This example also includes discrete conductive elements 162 surrounding the circular patch 106 in a discontinuous ring.

Figure 24:
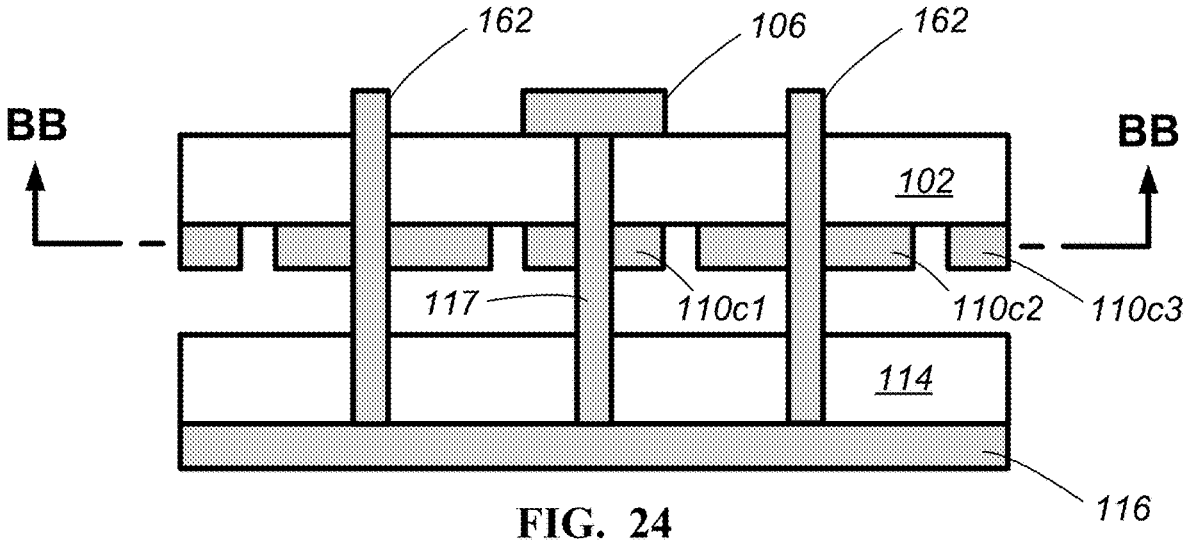
FIG. 24 is a simplified cross section along line AA-AA of the connected-slot antenna shown in FIG. 23 in accordance with an embodiment.

FIG. 24 is a simplified cross section along line AA-AA of the connected-slot antenna shown in FIG. 23. This figure shows the circular patch on a frontside of the dielectric substrate 102 and conductive patches 110*c*1, 110*c*2, 110*c*3 on a backside of the dielectric substrate 102. The conductive patches may be arranged in a pattern that provides circular symmetry similar to the examples shown in FIGS. 5*a*-5*b*. FIG. 24 also shows a dielectric 114, a ground plane 116, and a via 117. This figure also shows discrete conductive elements 162 coupled with the ground plane 116. In this example, the discrete conductive elements 162 may be vias extending between the frontside of the dielectric substrate 102 and the ground plane 116. The discrete conductive elements 162 may also be conductive elements that are electrically connected to a shield (or ground) of a transmission line. The discrete conductive elements 162 may also comprise a conductive pin or other connector that may also be used to hold features of the connected-slot antenna together.

Figure 25:
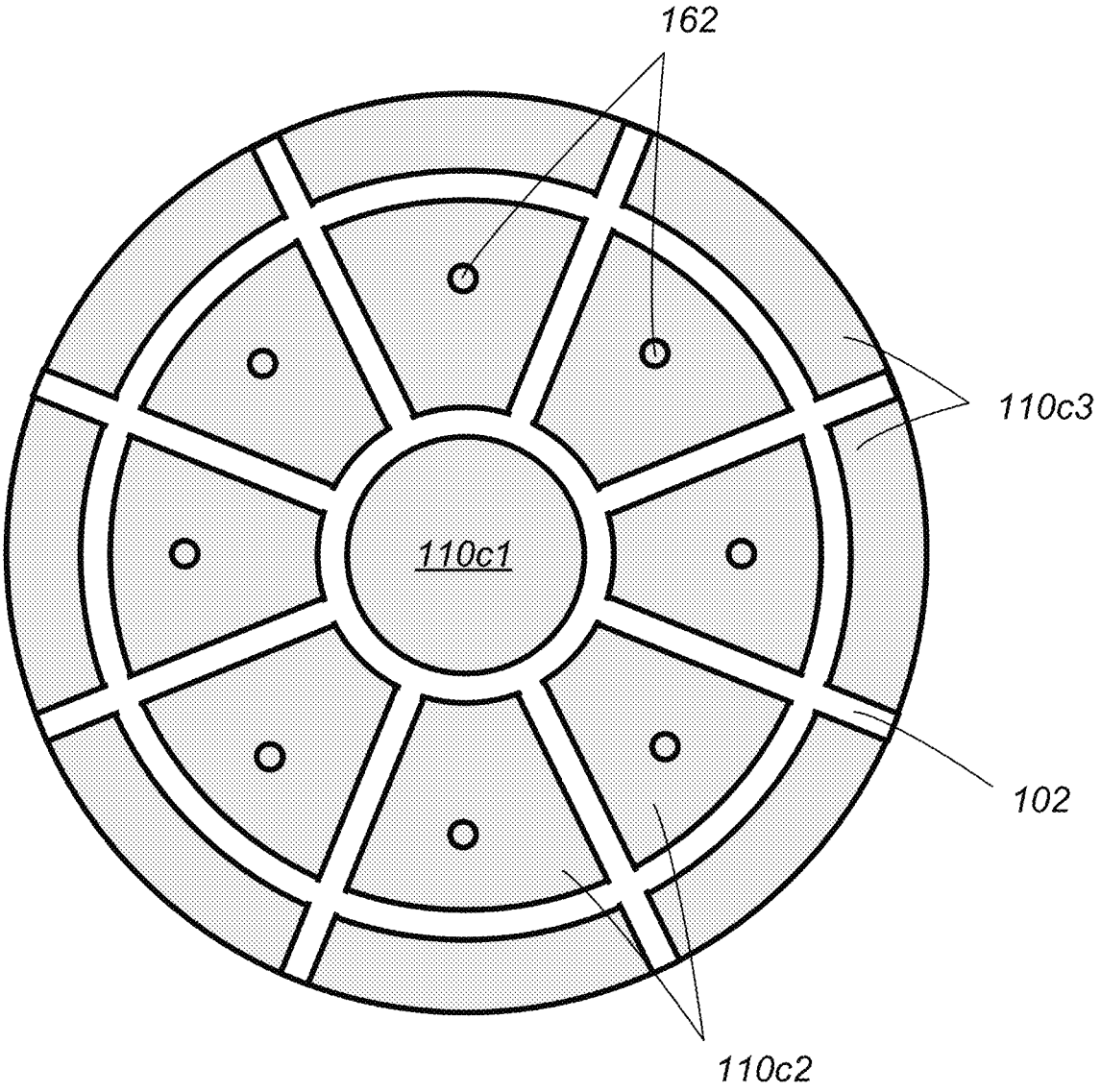
FIG. 25 is a simplified view along line BB-BB of the connected-slot antenna shown in FIG. 24 in accordance with some embodiments.

FIG. 25 is a simplified view along line BB-BB of the connected-slot antenna shown in FIG. 24. This figure shows the conductive patches 110*c*1, 110*c*2, 110*c*3 and the discrete conductive elements 162. The conductive patches 110*c*2 and the discrete conductive elements 162 may be electrically coupled in some embodiments. The conductive patches may have different shapes as described previously. The discontinuous ring may be used in place of the conductive ring in any of the embodiments described herein.

FIGS. 26-30 are simplified cross sections of connected-slot antennas in accordance with some embodiments. These figures are intended to show some of the different features of the connected-slot antennas. Rather than showing every possible configuration, it should be appreciated that the features from one figure can be combined with features from other figures. Also, any of the patterns of conductive patches described herein may be used with any of the embodiments. As described above with regard to FIG. 2, the first and second vias 112, 117 may or may not extend through dielectric substrate 102 in some embodiments.

Figure 26:
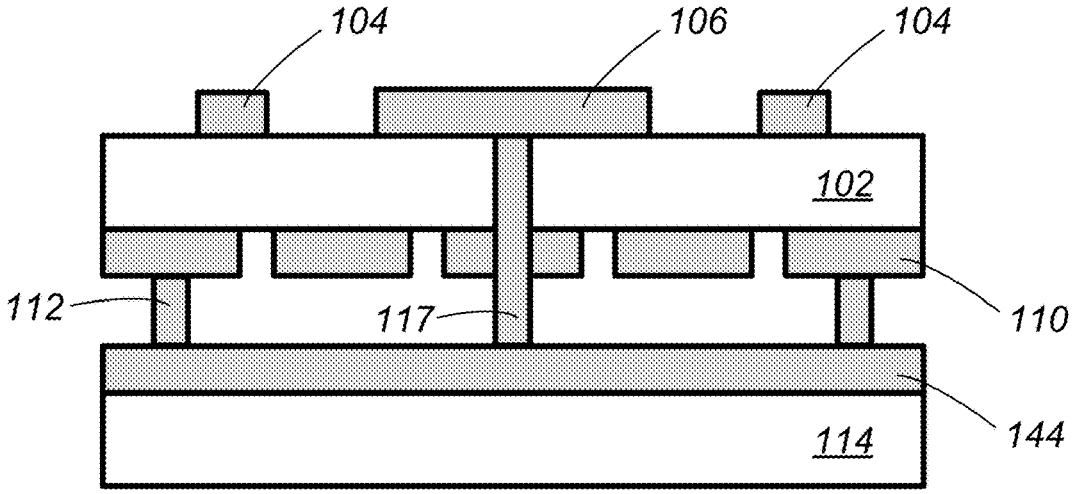
FIGS. 26-30 are simplified cross sections of connected-slot antennas in accordance with some embodiments.

FIG. 26 shows a connected-slot antenna with a ground plane 144 that overlies a dielectric 114 in accordance with an embodiment. This example is similar to that of FIG. 2, except that the ground plane 144 overlies (instead of underlies) the dielectric 114. In this example, the conductive patches 110 are only separated from the ground plane 144 by a gap between them. This gap may be filled with air or another dielectric. The exact configuration of the ground plane (over or under the dielectric 114) can be determined based on a desired size and intended use of the connected-slot antenna.

Figure 27:
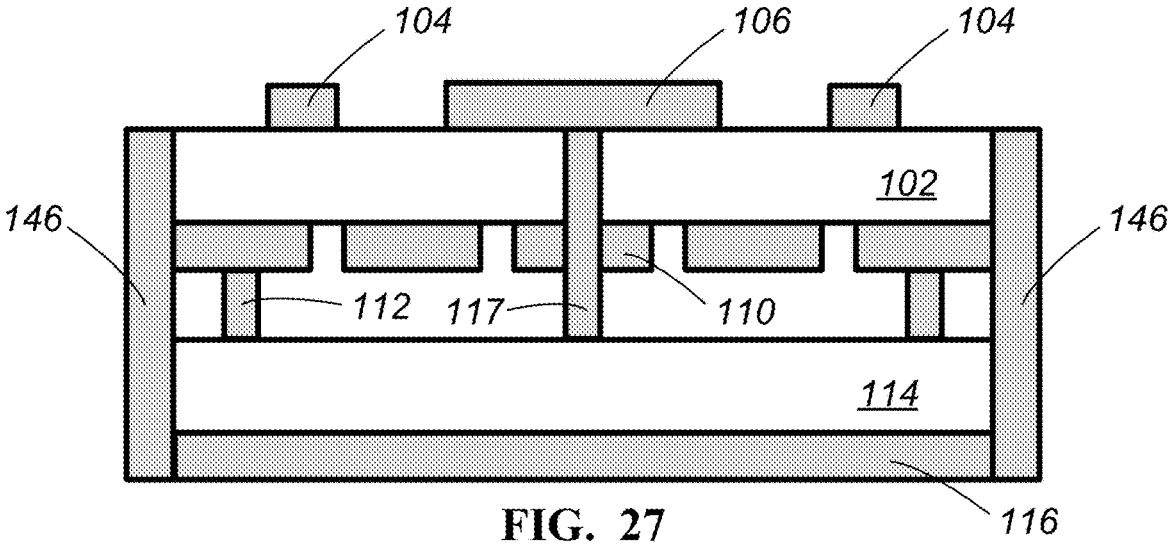

FIGS. 27-28 are shown with a ground plane 116 that underlies a dielectric 114, but in other embodiments, the examples shown in these figures could instead have a ground plane that overlies the dielectric 114 similar to the example shown in FIG. 26.

FIG. 27 shows a connected-slot antenna with a conductive fence 146 in accordance with another embodiment. The conductive fence 146 extends around a perimeter of the conductive patches 110 and around a perimeter of the ground plane 116. In this example, the conductive fence 146 also extends around a perimeter of the dielectric substrate 102 and the dielectric 114.

The conductive fence may be considered to be part of a metamaterial ground plane (along with conductive patches and a ground plane). The conductive fence can eliminate discontinuities at the edges of the conductive patches and the ground plane and form a cavity with the ground plane. This can reduce residual surface waves by shorting them to ground. The conductive fence can improve LHCP isolation, low elevation angle sensitivity, antenna bandwidth, and multipath resilience.

The conductive fence 146 may comprise a conductive material such as a metal or alloy and may be electrically grounded. In an embodiment, the conductive fence 146 is shaped like a band that surrounds the conductive patches 110 and the ground plane. The conductive fence 146 may abut a portion of the conductive patches 110 (those conductive patches 110 that are disposed along a perimeter) and the ground plane 116. In some embodiments, the conductive fence 146 and the ground plane 116 may be combined to form a single conductive element (e.g., a cavity or shield). In some embodiments, the dielectric 114 in this example may be air and the first and second vias 112, 117 may extend to the ground plane 116.

FIG. 28 shows a connected-slot antenna with a conductive fence 148 in accordance with another embodiment. In this example, the conductive fence 148 also extends around a perimeter of the conductive patches 110 and around a perimeter of the ground plane (which could be either over or under dielectric 114). The conductive fence 148 does not, however, extend around a perimeter of the dielectric substrate 102. Instead, the conductive fence 148 extends to a bottom of the dielectric substrate 102. Also, in this example, a center via only extends from the ground plane to one of the conductive patches 110 (rather than through the dielectric substrate 102). This example is shown merely to illustrate a feature that may be used with any of the embodiments described herein. No specific relationship is intended between the the shorter center via and the conductive fence 148 shown in this example. This embodiment may be more compact, lighter, and cheaper to produce than the embodiment shown in FIG. 20 because the conductive fence 148 is shorter.

In this example, conductive patches 110 are arranged along a first plane, and the ground plane 116 is arranged along a second plane. The conductive fence 148 extends from the first plane to the second plane and around a perimeter of the conductive patches 110 and a perimeter of the ground plane 116. A major surface of the conductive fence 148 extends substantially perpendicular to the first plane and the second plane. In some embodiments, the conductive fence 148 and the ground plane 116 may be combined to form a single conductive element (e.g., a cavity or shield). In some embodiments, the dielectric 114 in this example may be air and the first vias 112 may extend to the ground plane 116.

FIG. 29 shows a connected-slot antenna with a conductive fence 150 in accordance with another embodiment. This example includes conductive patches 110 arranged along a first plane and a ground plane 144 arranged along a second plane. Similar to FIG. 28, the conductive fence 150 extends from the first plane to the second plane and around a perimeter of the conductive patches 110 and a perimeter of the ground plane 144.

FIG. 30 shows a connected-slot antenna with a conductive fence 152 in accordance with another embodiment. In this example, conductive patches 110 are disposed along a top surface of dielectric 114, and a ground plane 116 is disposed along a bottom surface of the dielectric 114. Similar to the previous examples, the conductive patches 110 are arranged along a first plane, the ground plane 116 is arranged along a second plane, and the conductive fence 152 extends from the first plane to the second plane and around a perimeter of the conductive patches 110 and a perimeter of the ground plane 116.

Figure 31:
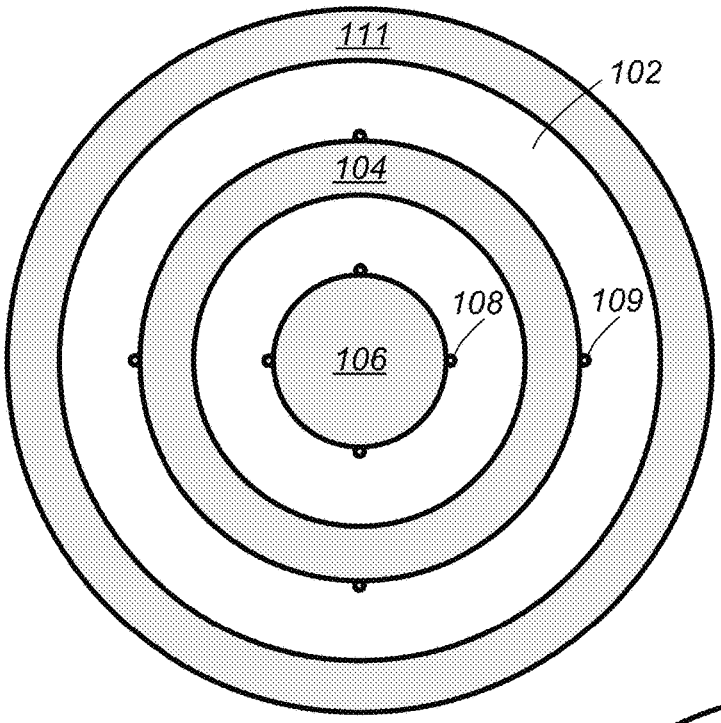
FIGS. 31-32 are simplified top views of connect slot antennas in accordance with some embodiments.

FIG. 31 is a simplified top view of a connect slot antenna in accordance with an embodiment. This example is similar to previous examples in that it includes a circular patch 106 and conductive ring 104 overlying a dielectric substrate 102. This example also includes four feeds 108 coupled to the circular patch 106. This example is different from the previous examples in that it includes a second conductive ring 111 overlying the dielectric substrate 102 and surrounding the first conductive ring 104. Also, second feeds 109 are coupled to the first conductive ring 104.

In this example, the circular patch 106 and the first conductive ring 104 are separated by a first connected slot, and the first conductive ring 104 and the second conductive ring 111 are separated by a second connected slot. Like the first feeds 108, the second feeds 109 are spaced from adjacent second feeds 109 by approximately equal angular intervals.

This embodiment is provided as an example of a connected-slot antenna that includes multiple conductive rings. Other embodiments may include additional conductive rings with additional feeds. The number of conductive rings and the number of feeds may be determined based on desired operating frequency bands.

Figure 32:
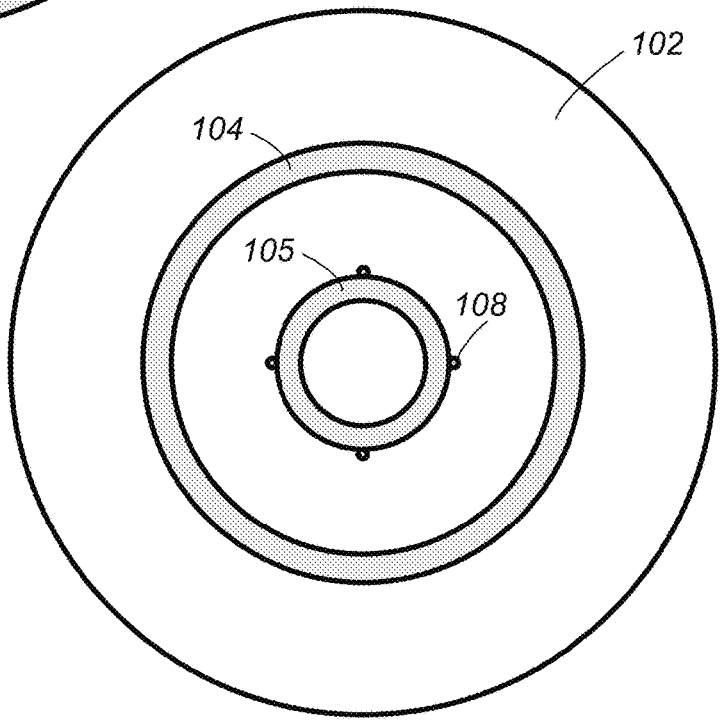

FIG. 32 is a simplified top view of a connect slot antenna in accordance with an embodiment. This example is different from previous examples in that the circular patch is replaced with an inner conductive ring 105. The inner conductive ring 105 may be electrically floating or grounded. The inner conductive ring 105 may comprise a conductive material such as a metal or alloy. This example is shown merely to illustrate a feature that may be used with any of the embodiments described herein. A conductive ring 104 surrounds the inner conductive ring 105, and four feeds 108 are coupled to the inner conductive ring 105. No specific relationship is intended between the inner conductive ring 105 and the conductive ring 104 and/or the feeds 108 shown in this example.

While the present invention has been described in terms of specific embodiments, it should be apparent to those skilled in the art that the scope of the present invention is not limited to the embodiments described herein. For example, features of one or more embodiments of the invention may be combined with one or more features of other embodiments without departing from the scope of the invention. The specification and drawings are, accordingly, to be regarded in an illustrative rather than a restrictive sense. Thus, the scope of the present invention should be determined not with reference to the above description, but should be determined with reference to the appended claims along with their full scope of equivalents.

What is claimed is:

1. A circularly polarized antenna, comprising:

a first dielectric substrate having a front side and a back side opposite the front side;

a second dielectric substrate spaced from the first dielectric substrate, the second dielectric substrate having a front side and a back side opposite the front side, wherein the first dielectric substrate and the second dielectric substrate are arranged so that a back side of the first dielectric substrate faces a front side of the second dielectric substrate;

a circular patch configured as a radiating element, the circular patch disposed on the front side of the first dielectric substrate;

a first conductive ring disposed on the front side of the first dielectric substrate surrounding the circular patch such that a space extends between the first conductive ring and the circular patch;

one or more antenna feeds coupled to the circular patch;

a metamaterial ground plane comprising:

a plurality of conductive patches disposed on the back side of the first dielectric substrate, the plurality of conductive patches including a center conductive patch having a circular shape and a plurality of surrounding conductive patches that are spaced from the center conductive patch and extend radially outward in a pattern that provides circular symmetry with respect to a center of the circularly polarized antenna; and a ground plane disposed on the front side of the second dielectric substrate and electrically coupled to at least a first portion of the plurality of conductive patches.

2. The circularly polarized antenna of claim 1 wherein each of the one or more antenna feeds includes an impedance transformer, and the plurality of conductive patches are arranged in a pattern that provides circular symmetry with respect to a phase center of the circularly polarized antenna.

3. The circularly polarized antenna of claim 1 wherein the plurality of conductive patches include the center conductive patch surrounded in a radial direction by a plurality of intermediate conductive patches, and the plurality of intermediate conductive patches are surrounded in a radial direction by a plurality of outer conductive patches.

4. The circularly polarized antenna of claim 1 wherein the plurality of conductive patches include the center conductive patch surrounded in a radial direction by a plurality of intermediate conductive patches each having a curved edge that is equidistant from a center of the center conductive patch.

5. The circularly polarized antenna of claim 1 wherein the plurality of conductive patches include the center conductive patch surrounded in a radial direction by a plurality of intermediate conductive patches extending radially to an outer edge of the first dielectric substrate.

6. The circularly polarized antenna of claim 1 wherein the plurality of conductive patches include the center conductive patch surrounded in a radial direction by a plurality of intermediate conductive patches that are surrounded in a radial direction by a plurality of outer conductive patches.

7. An antenna configured to receive radiation at global navigation satellite system (GNSS) frequencies, comprising:

a first dielectric substrate having a front side and a back side opposite the front side;

a second dielectric substrate spaced from the first dielectric substrate, the second dielectric substrate having a front side and a back side opposite the front side, wherein the first dielectric substrate and the second dielectric substrate are arranged so that a back side of the first dielectric substrate faces a front side of the second dielectric substrate;

a circular patch configured as a radiating element, the circular patch disposed on the front side of the first dielectric substrate;

a ring disposed on the front side of the first dielectric substrate surrounding the circular patch and spaced from the circular patch;

one or more impedance transformers, each of the one or more impedance transformers coupled to a first input feed and coupled to the circular patch at an output; and a metamaterial ground plane comprising:

a plurality of conductive patches disposed on the back side of the first dielectric substrate, the plurality of conductive patches arranged including a center conductive patch having a circular shape and a plurality of surrounding conductive patches that are spaced from the center conductive patch and extend radially outward in a pattern that provides circular symmetry with respect to a center of the antenna; and a ground plane disposed on the back side of the second dielectric substrate and electrically coupled to at least a first portion of the plurality of conductive patches.

8. The antenna of claim 7 wherein the plurality of conductive patches are arranged in a pattern that provides circular symmetry with respect to a phase center of the antenna.

9. The antenna of claim 7 wherein the ring is a discontinuous ring comprising discrete conductive elements surrounding the circular patch, each of the discrete conductive elements isolated from the circular patch.

10. The antenna of claim 7 wherein the plurality of conductive patches include the center conductive patch surrounded in a radial direction by a plurality of intermediate conductive patches.

11. The antenna of claim 10 wherein the plurality of intermediate conductive patches each have a curved edge, and each of the curved edge is equidistant from a center of the center conductive patch.

12. The antenna of claim 10 wherein the plurality of intermediate conductive patches extend radially to an outer edge of the first dielectric substrate.

13. The antenna of claim 10 wherein the plurality of intermediate conductive patches are surrounded in a radial direction by a plurality of outer conductive patches.

14. The antenna of claim 13 wherein the plurality of outer conductive patches extend radially to an outer edge of the first dielectric substrate.

15. A circularly polarized antenna, comprising:

a first dielectric substrate having a front side and a back side opposite the front side;

a second dielectric substrate spaced from the first dielectric substrate, the second dielectric substrate having a front side and a back side opposite the front side, wherein the first dielectric substrate and the second dielectric substrate are arranged so that a back side of the first dielectric substrate faces a front side of the second dielectric substrate;

a circular patch configured as a radiating element, the circular patch disposed on the front side of the first dielectric substrate;

a first conductive ring disposed on the front side of the first dielectric substrate and surrounding the circular patch such that a space extends between the first conductive ring and the circular patch;

one or more antenna feeds coupled to the circular patch;

a metamaterial ground plane comprising:

a plurality of conductive patches disposed on the back side of the first dielectric substrate or a front side of the second dielectric substrate, the plurality of conductive patches including a center conductive patch having a circular shape and a plurality of surrounding conductive patches that are spaced from the center conductive patch and extend radially outward in a pattern that provides circular symmetry with respect to a center of the circularly polarized antenna; and a ground plane disposed on the back side of the second dielectric substrate and electrically coupled to at least a first portion of the plurality of conductive patches.

16. The circularly polarized antenna of claim 15 wherein the plurality of conductive patches include the center conductive patch surrounded in a radial direction by a plurality of intermediate conductive patches.

17. The circularly polarized antenna of claim 16 wherein the plurality of intermediate conductive patches each have a curved edge, and each of the curved edge is equidistant from a center of the center conductive patch.

18. The circularly polarized antenna of claim 16 wherein the plurality of intermediate conductive patches extend radially to an outer edge of the first dielectric substrate or the second dielectric substrate.

19. The circularly polarized antenna of claim 16 wherein the plurality of intermediate conductive patches are surrounded in a radial direction by a plurality of outer conductive patches.

20. The circularly polarized antenna of claim 19 wherein the plurality of outer conductive patches extending radially to an outer edge of the first dielectric substrate or the second dielectric substrate.

* * * * *